US008376019B2

(12) United States Patent
Van Klompenburg et al.

(10) Patent No.: US 8,376,019 B2
(45) Date of Patent: Feb. 19, 2013

(54) WINDOW ASSEMBLY WITH MOVABLE INTERIOR SASH

(75) Inventors: Marlo G. Van Klompenburg, Pella, IA (US); Kenneth E. Nossaman, Pella, IA (US); Kraig A. Downs, Pella, IA (US); Gabriel P. Gromotka, Pella, IA (US); Bruce A. Hagemeyer, Pella, IA (US); Gary E. Tagtow, Sioux Falls, SD (US); Daniel W. Parrish, Pella, IA (US); Scot C. Miller, Pella, IA (US); Andy Breuer, Newton, IA (US); Ranjith Rajendran, Troutdale, OR (US); Bruce Sievers, Pella, IA (US); Jeffrey Scott Belloma, Pella, IA (US); Mearl J. Minter, Oskaloosa, IA (US)

(73) Assignee: Pella Corporation, Pella, IA (US)

( * ) Notice: Subject to any disclaimer, the term of this patent is extended or adjusted under 35 U.S.C. 154(b) by 1238 days.

(21) Appl. No.: 11/327,027

(22) Filed: Jan. 6, 2006

(65) Prior Publication Data

US 2006/0150561 A1 Jul. 13, 2006

Related U.S. Application Data

(60) Provisional application No. 60/643,064, filed on Jan. 11, 2005, provisional application No. 60/642,813, filed on Jan. 11, 2005, provisional application No. 60/642,812, filed on Jan. 11, 2005, provisional application No. 60/642,811, filed on Jan. 11, 2005.

(51) Int. Cl.
*E06B 3/32* (2006.01)

(52) U.S. Cl. ..... 160/107; 160/178.1 R

(58) Field of Classification Search ..... 160/107, 160/178.1 R, 902; 49/62, 67; 16/260
See application file for complete search history.

(56) References Cited

U.S. PATENT DOCUMENTS

| | | | | |
|---|---|---|---|---|
| 651,464 | A | 6/1900 | Lint | |
| 1,934,546 | A * | 11/1933 | Lewerentz | 49/62 |
| 2,108,965 | A | 2/1938 | Gray | |
| 2,286,899 | A * | 6/1942 | Crescentini | 160/37 |
| 2,302,661 | A * | 11/1942 | Benson | 16/267 |
| 2,568,130 | A | 7/1948 | Olson | |
| 2,629,466 | A | 2/1953 | Nardulli | |
| 2,709,582 | A | 5/1955 | Chapman | |

(Continued)

FOREIGN PATENT DOCUMENTS

| | | |
|---|---|---|
| DE | 3720995 A1 | 1/1989 |
| EP | 0041875 A1 | 12/1981 |

(Continued)

OTHER PUBLICATIONS

Internorm® company and product information, www.internorm.com, 5 pages.

(Continued)

*Primary Examiner* — Blair M. Johnson
(74) *Attorney, Agent, or Firm* — Faegre Baker Daniels LLP

(57) ABSTRACT

A window assembly having a window frame and at least one primary sash mounted in the window frame. The primary sash has a plurality of sash members forming a primary sash perimeter and a first glazing panel mounted in the primary sash perimeter. At least one secondary sash is pivotally attached directly to the primary sash perimeter along an interior surface thereof so that the secondary sash is rotatably movable between a closed position and an open position relative to the primary sash. The secondary sash has a plurality of secondary sash members forming a secondary sash structure and a second glazing panel mounted in the secondary sash perimeter. An air chamber is located between the primary sash and the secondary sash that is substantially closed to the interior of the building structure. At least one accessory channel is locating along at least one side of the secondary sash members.

27 Claims, 31 Drawing Sheets

U.S. PATENT DOCUMENTS

| | | | | |
|---|---|---|---|---|
| 2,877,840 | A | | 3/1959 | Hurowitz et al. |
| 3,103,351 | A | | 9/1963 | Ahlgren |
| 3,117,351 | A | | 1/1964 | Ahlgren |
| 3,291,193 | A | | 12/1966 | Hagerty et al. |
| 3,382,611 | A | | 5/1968 | Zandelin |
| 3,474,572 | A | | 10/1969 | Rothemund |
| 3,686,814 | A | | 8/1972 | Anderson |
| 3,694,985 | A | | 10/1972 | Spaiches |
| 3,703,920 | A | * | 11/1972 | Debs ..... 160/107 |
| 3,795,267 | A | * | 3/1974 | Debs ..... 160/168.1 R |
| 3,946,531 | A | | 3/1976 | Armstrong |
| 4,059,298 | A | | 11/1977 | Van Klompenburg |
| 4,060,950 | A | | 12/1977 | Rackard et al. |
| 4,095,829 | A | | 6/1978 | Van Klompenburg |
| 4,126,965 | A | | 11/1978 | Hoffmann |
| 4,154,033 | A | | 5/1979 | Krueger et al. |
| 4,160,348 | A | | 7/1979 | Chapman et al. |
| 4,182,088 | A | | 1/1980 | Ball |
| 4,223,481 | A | | 9/1980 | Page |
| 4,328,644 | A | | 5/1982 | Scott et al. |
| 4,369,828 | A | | 1/1983 | Tatro |
| 4,429,910 | A | | 2/1984 | Anderson |
| 4,555,884 | A | | 12/1985 | van Eerden |
| 4,616,443 | A | | 10/1986 | Araki et al. |
| 4,641,466 | A | | 2/1987 | Raninen et al. |
| 4,664,169 | A | | 5/1987 | Osaka et al. |
| 4,665,663 | A | | 5/1987 | Governale |
| 4,676,024 | A | | 6/1987 | Rossman |
| 4,683,693 | A | | 8/1987 | Rockar et al. |
| 4,687,040 | A | | 8/1987 | Ball |
| 4,707,963 | A | | 11/1987 | Governale |
| 4,733,510 | A | | 3/1988 | Werner |
| 4,783,938 | A | | 11/1988 | Palmer |
| 4,793,106 | A | | 12/1988 | Jonsson |
| 4,799,330 | A | * | 1/1989 | Hudson ..... 49/62 |
| 4,813,203 | A | | 3/1989 | Newman et al. |
| 4,833,754 | A | | 5/1989 | Yang |
| 4,856,239 | A | | 8/1989 | Elsasser |
| 4,873,803 | A | | 10/1989 | Rundo |
| 4,897,975 | A | | 2/1990 | Artwick et al. |
| 4,913,213 | A | | 4/1990 | Schnelker |
| 4,934,438 | A | | 6/1990 | Yuhas et al. |
| 4,970,840 | A | | 11/1990 | Ouellette et al. |
| 4,980,947 | A | | 1/1991 | McQuigge |
| 4,984,388 | A | | 1/1991 | Johnson |
| 5,000,242 | A | | 3/1991 | Coddens |
| 5,083,398 | A | | 1/1992 | Kolbeck et al. |
| 5,086,604 | A | | 2/1992 | Orth |
| 5,099,626 | A | | 3/1992 | Seeger |
| 5,115,610 | A | | 5/1992 | Kessler |
| 5,138,811 | A | | 8/1992 | Parrott |
| 5,152,103 | A | | 10/1992 | Tucker et al. |
| 5,174,091 | A | | 12/1992 | Stokx |
| 5,177,920 | A | | 1/1993 | Rafeld |
| 5,226,466 | A | | 7/1993 | Coddens |
| 5,253,457 | A | | 10/1993 | Orth |
| 5,282,504 | A | | 2/1994 | Anderson et al. |
| 5,299,399 | A | | 4/1994 | Baier et al. |
| 5,325,579 | A | | 7/1994 | Baier |
| 5,379,825 | A | | 1/1995 | Jelic |
| 5,390,454 | A | | 2/1995 | Coddens |
| 5,430,982 | A | | 7/1995 | Bane |
| 5,456,048 | A | | 10/1995 | White |
| 5,566,507 | A | | 10/1996 | Schmidt et al. |
| 5,611,381 | A | | 3/1997 | Jelic |
| 5,623,784 | A | | 4/1997 | Kuersten et al. |
| 5,649,389 | A | | 7/1997 | Coddens |
| 5,657,590 | A | | 8/1997 | Digman et al. |
| 5,678,376 | A | | 10/1997 | Poma |
| 5,678,377 | A | | 10/1997 | Leopold |
| 5,692,349 | A | | 12/1997 | Guillemet |
| 5,713,167 | A | | 2/1998 | Durham et al. |
| 5,791,102 | A | | 8/1998 | Sheath et al. |
| 5,806,256 | A | | 9/1998 | Byrne |
| 5,826,638 | A | | 10/1998 | Jelic |
| 5,899,033 | A | | 5/1999 | Merchlewitz |
| 5,927,768 | A | | 7/1999 | Dallmann et al. |
| 5,934,351 | A | | 8/1999 | Bharucha et al. |
| 5,996,668 | A | | 12/1999 | DeBlock et al. |
| 6,006,813 | A | | 12/1999 | Jelic |
| 6,009,931 | A | | 1/2000 | Peterson |
| 6,070,638 | A | | 6/2000 | Jelic |
| 6,128,871 | A | | 10/2000 | Corey |
| 6,131,356 | A | | 10/2000 | Gieseke |
| 6,164,024 | A | | 12/2000 | Konstantin |
| 6,173,754 | B1 | | 1/2001 | DeBlock |
| 6,186,306 | B1 | | 2/2001 | Kamm |
| D441,875 | S | | 5/2001 | Wylie |
| 6,244,012 | B1 | | 6/2001 | McGlinchy et al. |
| 6,421,960 | B1 | | 7/2002 | Manzella |
| 6,494,002 | B1 | | 12/2002 | Gieseke |
| 6,601,633 | B2 | | 8/2003 | Sun et al. |
| 6,640,389 | B2 | | 11/2003 | Van Klompenburg et al. |
| 6,691,370 | B2 | * | 2/2004 | Tatara ..... 16/355 |
| 6,718,704 | B2 | | 4/2004 | Plummer et al. |
| 6,736,185 | B2 | | 5/2004 | Smith et al. |
| 6,817,401 | B2 | | 11/2004 | Sun et al. |
| 6,932,139 | B2 | | 8/2005 | Early et al. |
| 6,959,748 | B2 | | 11/2005 | Hudoba |
| 7,021,360 | B2 | | 4/2006 | Schroder et al. |
| 7,082,982 | B2 | | 8/2006 | Eveland et al. |
| 7,653,969 | B2 | * | 2/2010 | Erskine et al. ..... 16/365 |
| 2003/0015300 | A1 | | 1/2003 | Colson et al. |
| 2006/0086051 | A1 | | 4/2006 | Woods et al. |
| 2006/0150514 | A1 | * | 7/2006 | Miller et al. ..... 49/345 |

FOREIGN PATENT DOCUMENTS

| | | |
|---|---|---|
| EP | 0119361 B1 | 9/1984 |
| GB | 1362072 | 7/1974 |

OTHER PUBLICATIONS

PCT Notification of Transmittal of the International Search Report and the Written Opinion of the International Searching Authority, or the Declaration for International Application No. PCT/US2006/000276, mailing date Dec. 14, 2006 (11 pages).

PCT Notification Concerning Transmittal of International Preliminary Report on Patentability (Chapter 1 of the Patent Cooperation Treaty) for International Application No. PCT/US2006/000276, mailing date Jul. 26, 2007 (7 pages).

U.S. Appl. No. 11/297,576, filed Dec. 8, 2005 and entitled Movable Light Latch, assigned to Pella Corporation, Published as US-2006-0150514-A1 on Jul. 13, 2006, available at the U.S. Patent and Trademark Office electronic database ("PAIR").

* cited by examiner

WINDOW ASSEMBLY WITH MOVABLE INTERIOR SASH

The present invention claims the benefit of U.S. Provisional application No. 60/643,064 entitled WINDOW ASSEMBLY WITH MOVABLE INTERIOR SASH filed on Jan. 11, 2005 which is incorporated herein by reference.

Provisional application Nos. 60/642,813 entitled WINDOW COVERING DRIVE SYSTEM; 60/642,812 entitled WINDOW COVERING LEVELING MECHANISM AND METHOD; and 60/642,811 entitled MOVABLE LIGHT LATCH, all filed on Jan. 11, 2005, are incorporated herein by reference.

FIELD OF INVENTION

The present invention relates to a window assembly with a primary sash and a secondary movable interior sash attached to the primary sash.

BACKGROUND OF THE INVENTION

Prior to the concern over energy efficiency and cost savings in building maintenance, many buildings, both residential and commercial, were constructed with a window assembly with a primary-glazing pane. In order to decrease thermal losses through window openings and increase the desirability and livability of these older buildings, either interior or exterior storm windows that create a multiple pane window unit, are used.

Exterior storm windows are typically mounted on the exterior of the building to cover the primary glazing and shield it from the environment. Such arrangements have served to provide improved insulation, but are also subject to certain drawbacks.

The exterior storm windows are usually constructed of rigid, weather resistant materials, such as aluminum or other metals. In addition, the exterior storm windows can be difficult to install and can require expensive, professional installation due to things such as ground landscaping or the height at which the windows would have to be installed. In some commercial buildings the window elevations are so extreme that exterior storm windows are not available as a practical matter. With certain historic buildings and condominium dwellings, use of exterior storm windows is prohibited by law or restrictive covenant. Even when such storm windows can be easily installed, to apply them over casement or awning windows typically restricts or entirely eliminates the workability of those window assemblies.

U.S. Pat. No. 4,160,348 (Chapman et al.); U.S. Pat. No. 4,369,828 (Tatro); and U.S. Pat. No. 5,282,504 (Anderson et al.) disclose interior storm windows attached to the window frame at the interior of the building. Such storm windows have, for example, been held in place by magnetic strips or guide tracks secured to the window frame adjacent to the primary glazing pane. The interior storm windows can be employed at all building elevations and are substantially unnoticeable from the building exterior, thus overcoming many of the limitations on usage of the exterior storm windows. Further, because these storm windows are on the inside of the building, they do not need to be as weather resistant.

However, interior storm windows typically require careful, on-site measurement of each window and largely custom construction often requiring professional installation. The finish trim often needs to be cut and stained at the site and installed separately from the storm window. Further, the interior storm windows often interfere with window hardware, such as handles and cranks for casement or awning windows. This hardware must be removed and the window assemblies rendered inoperative if the interior storm window is to be installed. Likewise, since interior storm windows are fixedly mounted to the window frame, the window's mounting frame and panes restrict access to the primary glazing pane for cleaning and/or removal of the primary glazing pane. Similarly, in window openings of lesser depth, use of the interior storm windows can preclude use of a Venetian blind or shade between the primary glazing pane and the storm window pane. Such between window mountings of blinds would otherwise be desirable to decrease the accumulation of dust on the blinds.

BRIEF SUMMARY OF THE INVENTION

The present invention is directed to a window assembly having a window frame and at least one primary sash mounted in the window frame. The primary sash has a plurality of sash members forming a primary sash perimeter and a first glazing panel mounted in the primary sash perimeter. At least one secondary sash is pivotally attached directly to the primary sash perimeter along an interior surface thereof so that the secondary sash is rotatably movable between a closed position and an open position relative to the primary sash. The secondary sash has a plurality of secondary sash members forming a secondary sash structure and a second glazing panel mounted in the secondary sash structure. An air chamber is located between the primary sash and the secondary sash. At least one accessory channel is located along at least one side of the secondary sash members. The secondary sash optionally includes an opening stop to prevent the secondary sash from opening beyond a preset limit.

When the secondary sash is in the closed position, the secondary sash and the primary sash preferably move as a unitary structure relative to the window frame. At least one of the sash members forming the secondary sash structure is preferably an extruded member. A hinge is optionally integrally formed in at least one of the sash members forming the secondary sash structure. The primary sash can be an in-swing door, a sliding door, an out-swing door, a double hung window, a casement window, an awning window, a fixed window, or the like.

A window accessory operating mechanism is preferably located in the accessory channel. At least one window accessory mounting post is preferably attached to one of the plurality of sash members forming the secondary sash structure and located in the closed air chamber. At least one drive opening preferably extends through at least one of the sash members forming the secondary sash structure between the accessory channel and the closed air chamber. A window accessory is preferably located in the air chamber and releasably attached to at least one of the sash members forming the secondary sash structure.

In one embodiment, a first drive coupler extends through a side sash member forming the secondary sash structure. The first drive coupler is releasably coupled with a second drive coupler on a window accessory located in the air chamber. A window accessory drive mechanism is located in the accessory channel mechanically coupled to the first drive coupler. The first drive coupler preferably slidingly engages with the second drive coupler.

In another embodiment, at least two window accessory mounting structures are located in the closed air chamber and attached to a top sash members forming the secondary sash structure. The mounting structures are separated by a fixed distance. The window accessory preferably has a shade mechanism housing with first and second slots separated by the fixed distance. The first slot extends generally parallel to an axis of the shade mechanism housing and the second slot extends generally perpendicular to the axis of the shade mechanism housing. In one embodiment, the first drive coupler extends through a side sash member forming the secondary sash structure. The first drive coupler is located to mechanically couple with a second drive coupler on the window accessory when the window accessory is attached to the first and second mounting structures. A window accessory drive mechanism is located in the accessory channel mechanically coupled to the first drive coupler. At least one of the first and second slots preferably has one or more detents to releasably engage with the mounting structures.

In one embodiment, a glazing flange is located between the first glazing panel and the plurality of sash members forming the primary sash. The glazing flange is preferably a unitary structure attached to the primary sash perimeter. In one embodiment, the glazing flange is pre-formed in the shape of the primary sash and the individual sash members are then attached to the pre-formed glazing flange, locking the glazing flange into place. The glazing flange is preferably a welded polymeric structure attached to the primary sash perimeter. In another embodiment, the glazing flange can be metal or wood. Exterior cladding is optionally attached along at least one edge to the glazing flange. The glazing flange preferably forms an interlocking relationship with the plurality of sash members. An adhesive is optionally used to attach the first glazing panel to the glazing flange.

In another embodiment, at least one attachment region is located on the plurality of sash members forming the secondary sash. The attachment region is positioned in the closed air chamber. A plurality of muntin bar clips form a snap-fit relationship with the attachment region to fixedly position a muntin bar assembly in the closed air chamber. A window shade operable from the accessory channel is optionally located in the closed air chamber with the muntin bar assembly.

The window assembly may further include one or more window accessories (e.g., a grid, a grille, a shade, a screen, a blind, a window fashion, etc.) and one or more window accessory operating mechanisms. The window accessory is placed in the air chamber, while the window accessory operating mechanism is placed in the recessed region of the secondary sash. The window accessory operating mechanism is adapted to operate the window accessory. The window assembly may include a lock mechanism for locking the second sash in the closed position. The grille may be held in place using clips that attach to the primary sash or the secondary sash. The clips may include a spring portion and an engagement portion.

DETAILED DESCRIPTION OF THE INVENTION

Figure 1:
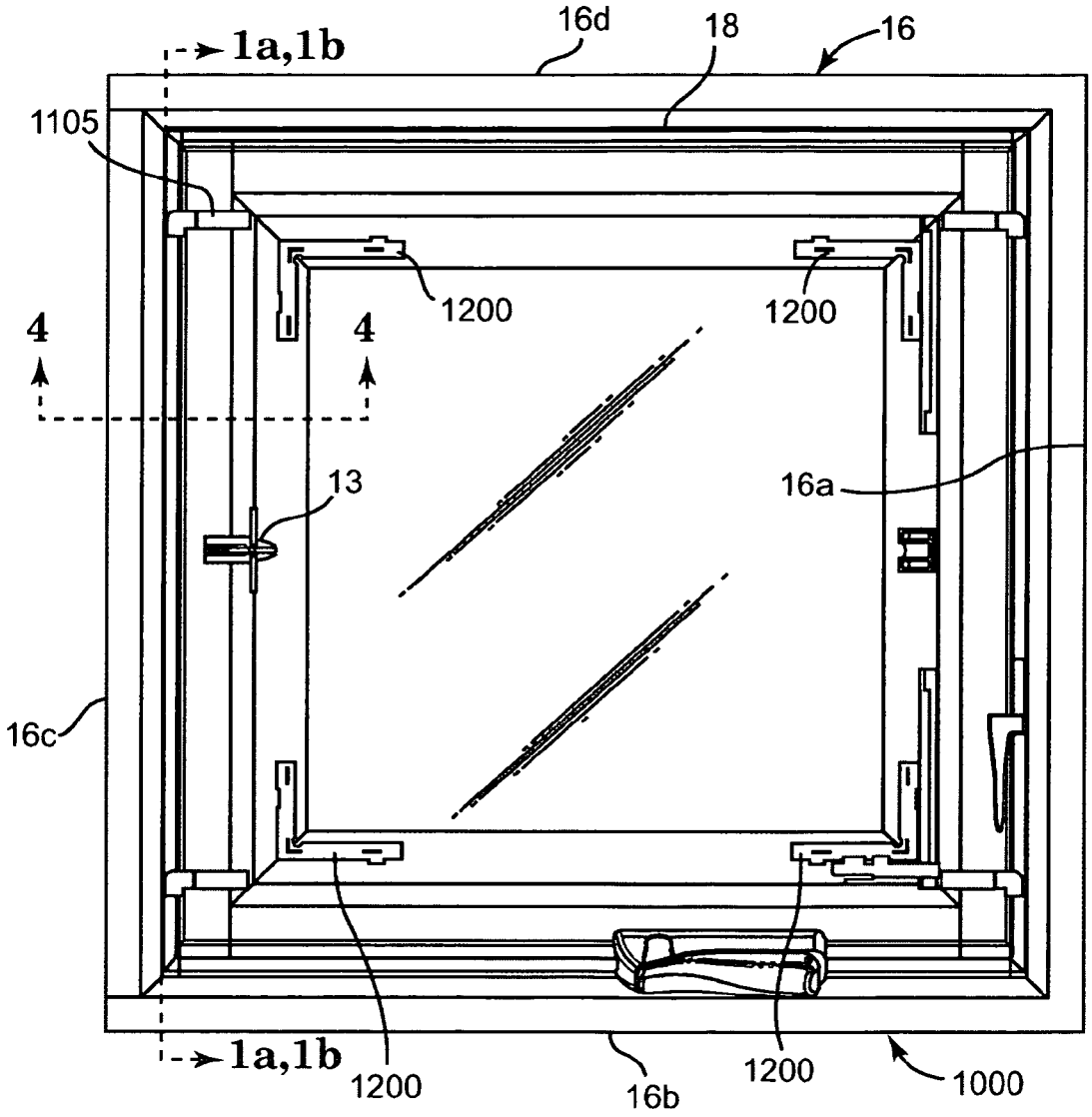
FIG. 1 is a partial see-through inside elevation view of a window assembly with a primary sash and a secondary sash attached to the primary sash in accordance with the present invention.
Figure 1A:
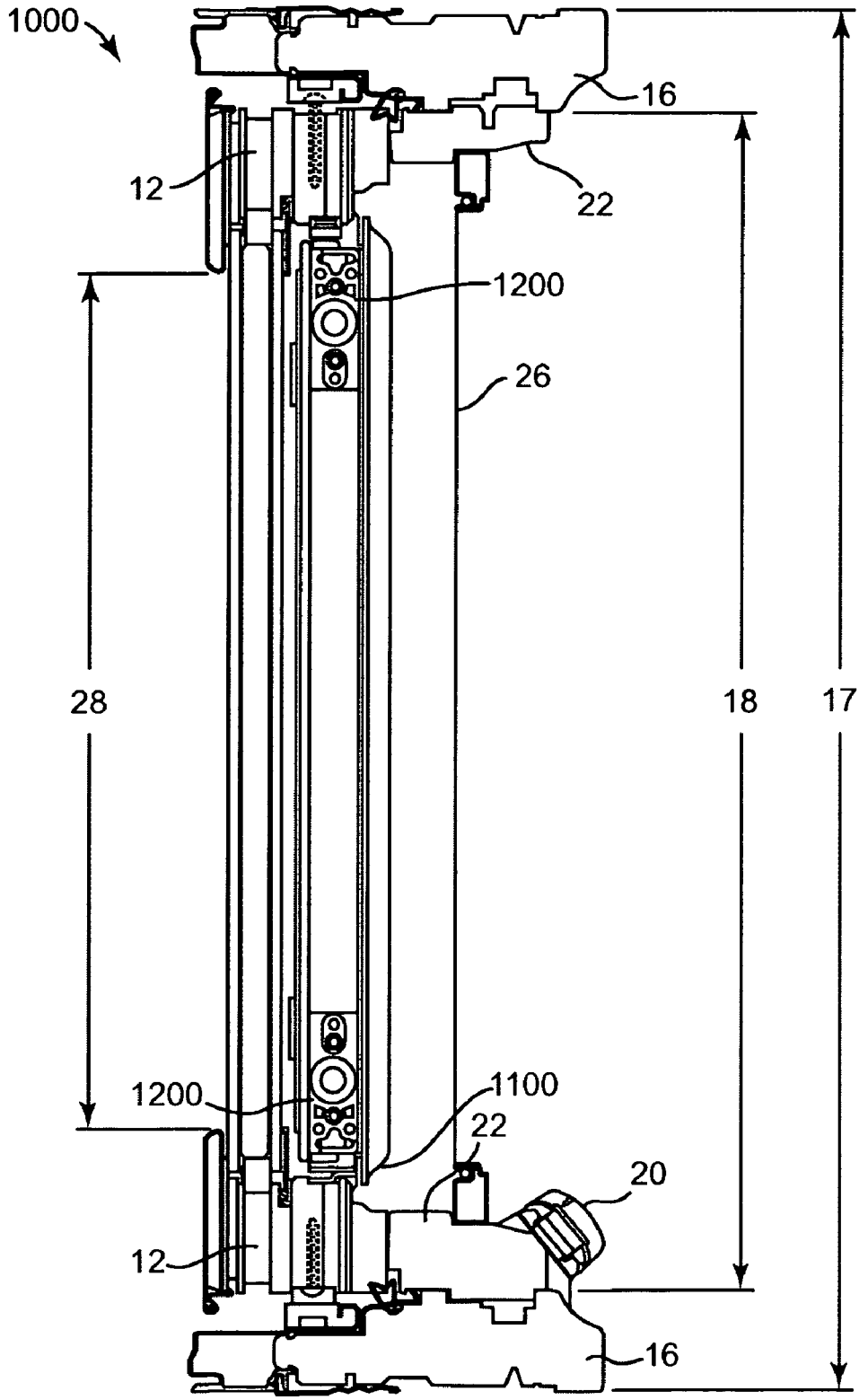
FIG. 1*a* is a cross-sectional view of the window assembly of FIG. 1 taken along line 1*a*, 1*b*-1*a*, 1*b*.
Figure 1B:
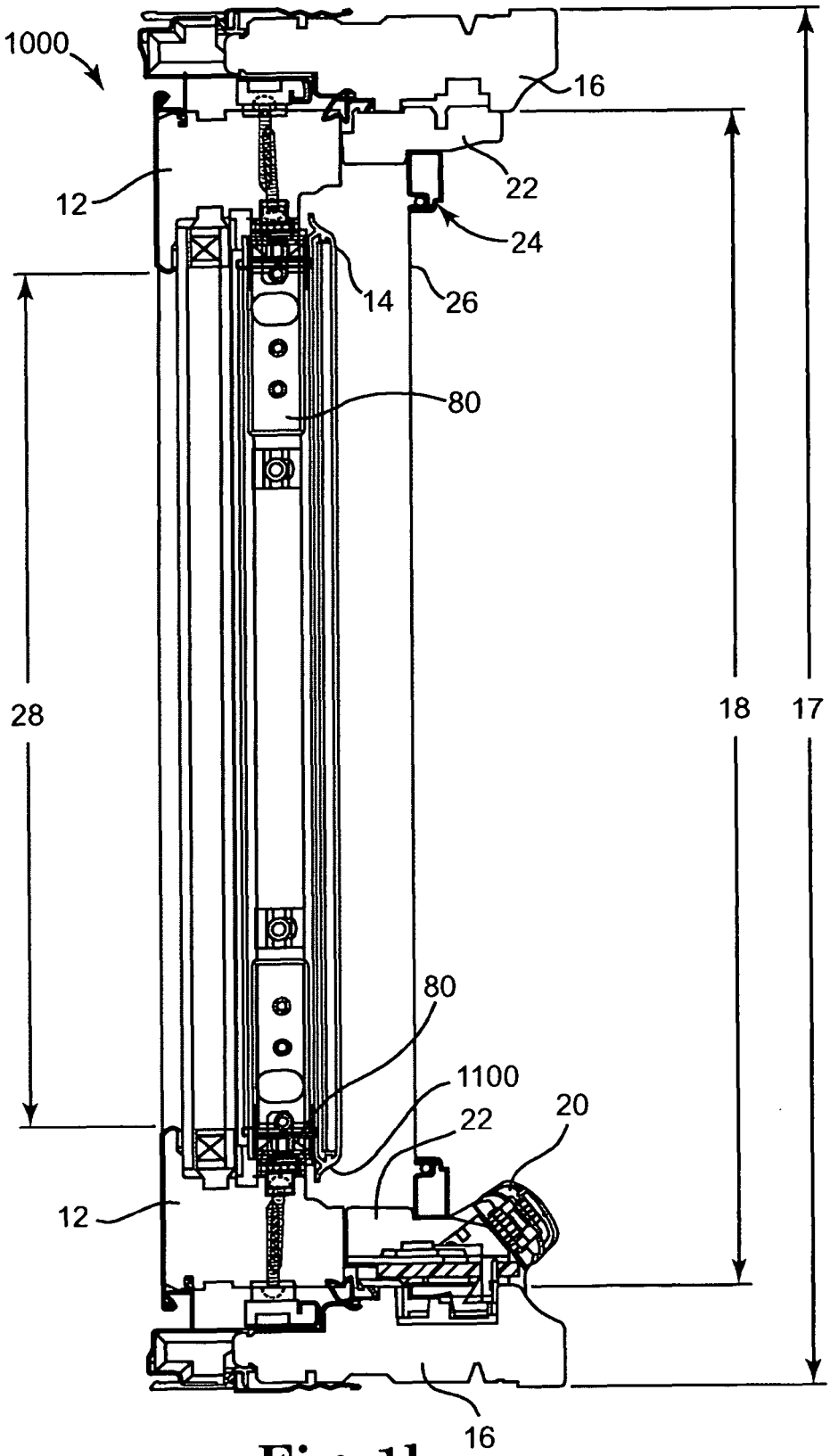
FIG. 1*b* is a cross-sectional view of an alternative embodiment of the window assembly shown in FIG. 1*a*.

Referring now to FIGS. 1, 1*a* and 1*b*, an embodiment of a window assembly 1000 in accordance with the present invention can be seen as it would be viewed from inside a structure in which it is installed. The window assembly 1000 includes a window frame 16 adapted to be received in a rough opening created in a building structure (not shown). As used herein the phrase "window frame" refers to a framework mounted in a rough opening of a building structure for receiving and supporting one or more sashes of a window assembly. As used herein, the term "sash" refers to a framework for receiving and supporting one or more glazing panes. In doors, double hung windows, awning windows, and casement windows, the sashes can be moved relative to the window frame. In a fixed window, the sash does not typically move relative to the window frame, but can be removed for repair purposes.

The window frame 16 can be constructed of wood, vinyl, aluminum, or a variety of other materials. In the illustrated embodiment, the window frame 16 includes four peripheral frame members, 16*a*, 16*b*, 16*c*, and 16*d*, joined and secured together to form a rectangular shape corresponding to the size and shape of the rough opening 17. The inner perimeter of the rough opening is slightly larger than the perimeter of the window frame 16 of the window assembly 1000, so that the window assembly 1000 can be received in the rough opening during installation. The methods of mounting the window frame 16 to the rough opening are well known in the window industry. The window frame 16 defines a window opening 18. In the illustrated embodiment, the window opening 18 has a rectangular shape. Although the window assembly 1000 in the illustrated embodiment is rectangular, it is understood that the present invention is not limited by the shape of the window assembly.

The window assembly 1000 also includes a first or primary sash 12 attached to the window frame 16 and received in the window opening 18 defined by the window frame 16. In the illustrated embodiment, the primary sash 12 is operated in the same or a similar manner as a conventional casement window with a vertical edge of the primary sash 12 hinged to the jamb of the window frame 16 allowing the opposite vertical edge of the primary sash 12 to swing outwardly from the window frame 16.

The primary sash 12 may be made from a durable material, such as for example wood, vinyl, aluminum or variety of other materials. The methods of making window sashes are well known in the window manufacturing industry.

In the illustrated embodiment, sash operator 20 for opening and closing the primary sash 12 is a crank that actuates a linkage for pushing/pulling the primary sash 12 open and pulling/pushing it shut. The window assembly 1000 may include a decorative wood trim or frame stop 22 mounted to the window frame 16 along the inner perimeter of the window frame 16. Further, a screen 26 can optionally be included in the window assembly 1000.

Figure 2:
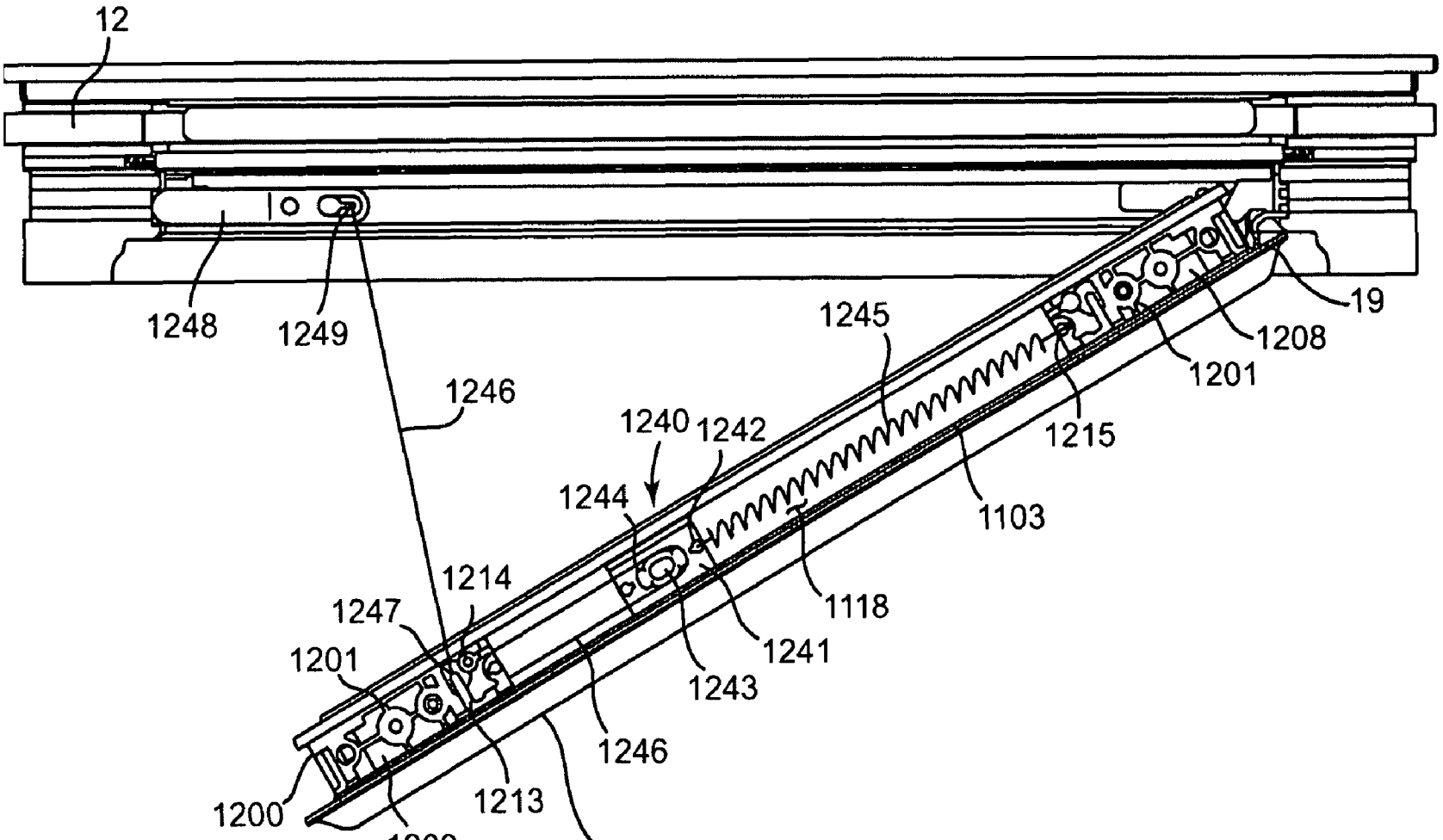
FIG. 2 is a top view of the primary and secondary sashes of the window assembly of FIG. 1, where the secondary sash is in its open position.
Figure 2A:
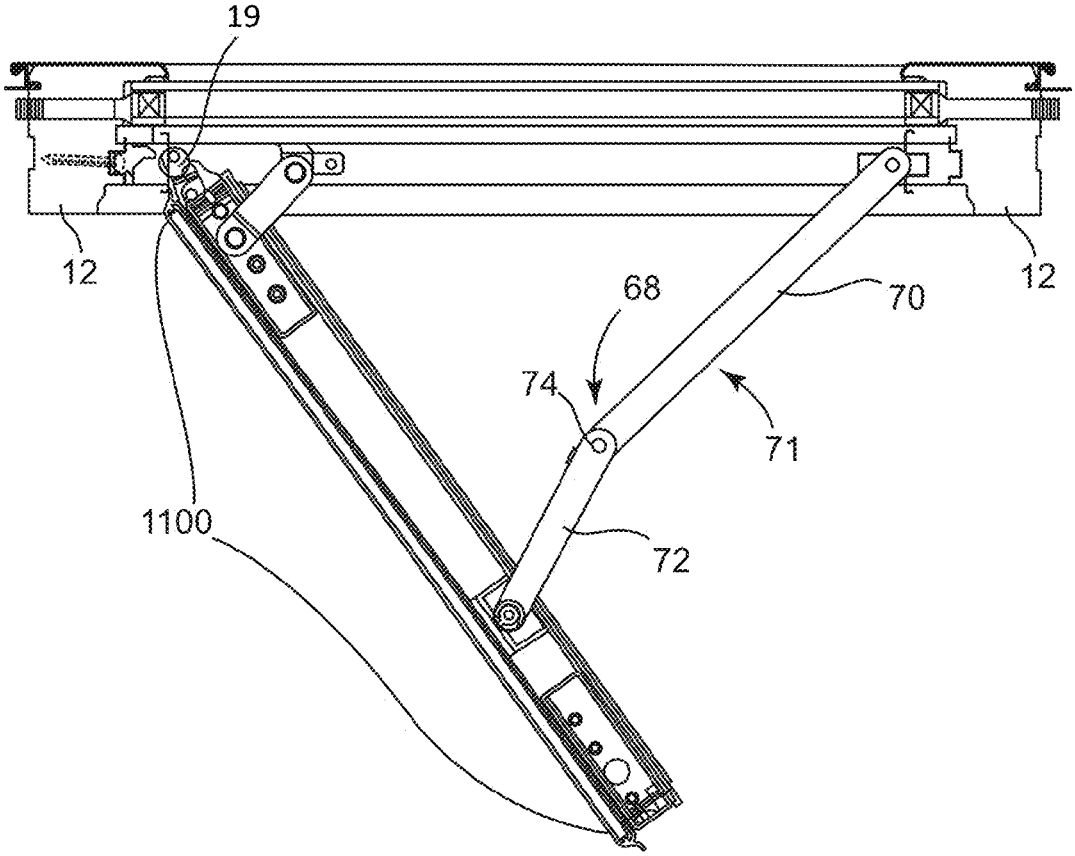
FIG. 2*a* is a top view of the sash shown in FIG. 1*b* in its open position.
Figure 3:
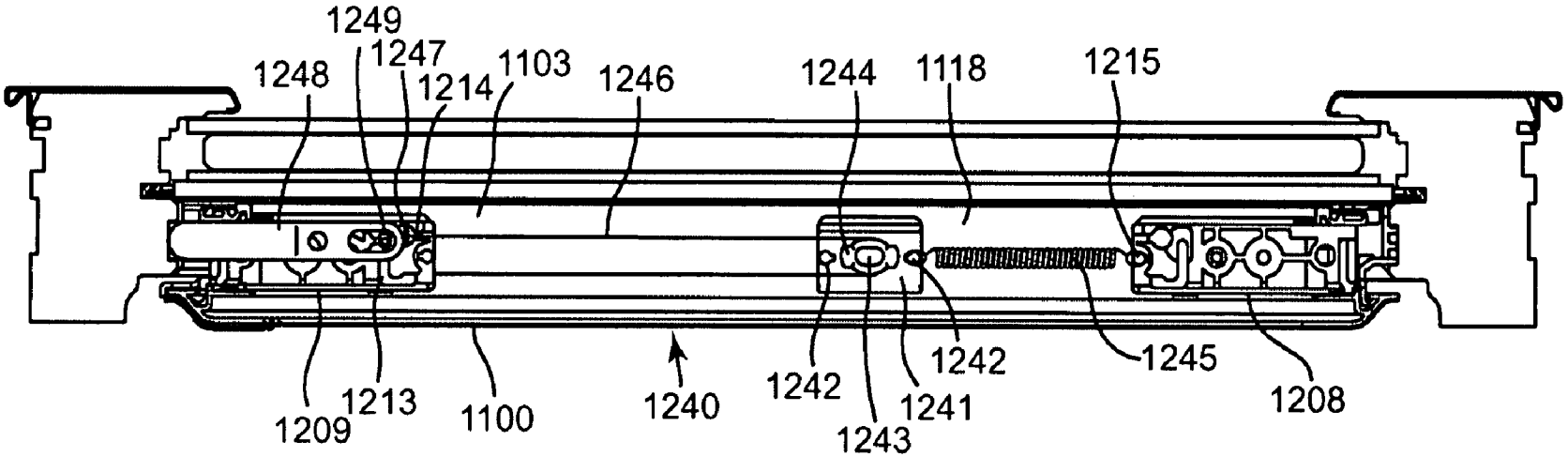
FIG. 3 is a top view of the primary and secondary sashes of the window assembly of FIG. 1, where the secondary sash is in its closed position.
Figure 3A:
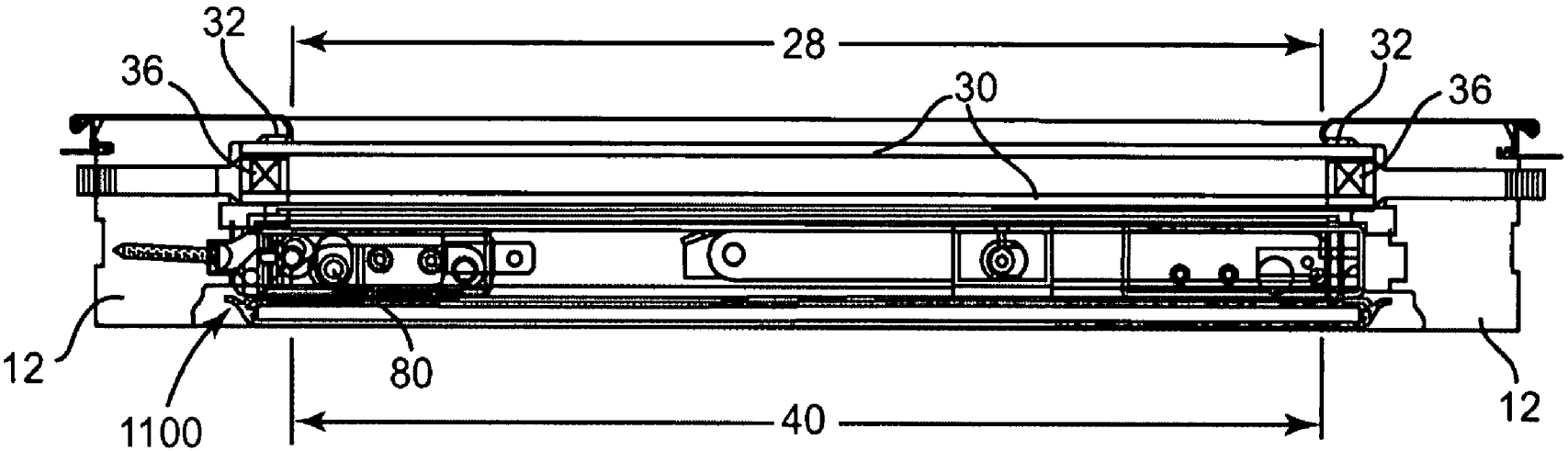
FIG. 3*a* is a top view of the sash of FIG. 1*b* in its closed position.

Referring to FIGS. 2, 2*a*, 3 and 3*a*, the primary sash 12 and a secondary sash 1100 of the window assembly 1000 can be seen. In particular, FIGS. 2 and 2*a* show the secondary sash 1100 in an open position, while FIGS. 3 and 3*a* show that the secondary sash 1100 is in a closed position. In the embodiment of FIG. 2, the secondary sash 1100 is pivotally attached to the primary sash 12 by one or more hinge members 19. Although the present embodiments are directed to a casement window, all discussions herein of the secondary sash 1100 apply equally to double hung windows, awning windows, hinged or sliding doors, and fixed windows.

Figure 3B:
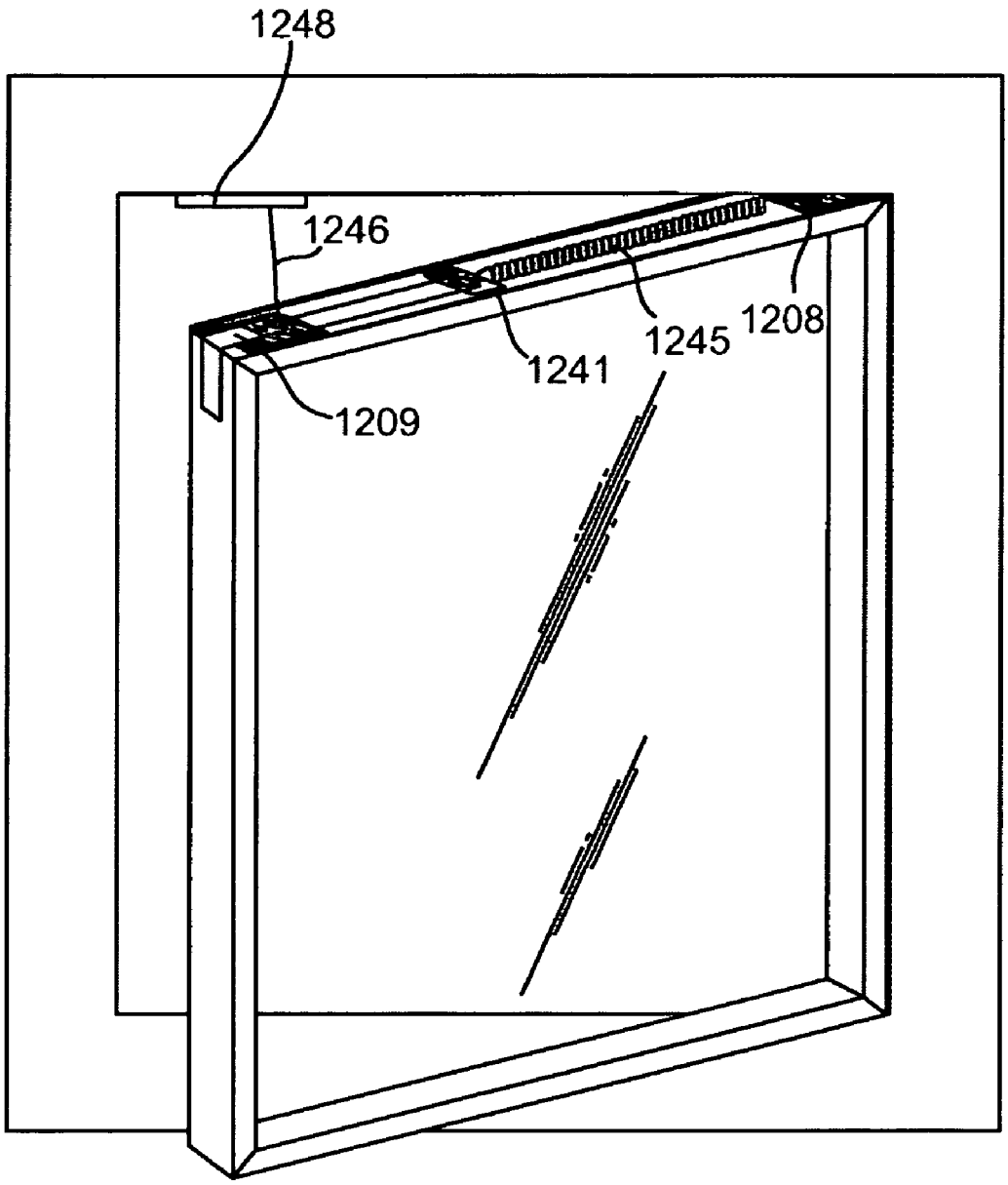
FIG. 3*b* is a front elevation view of a secondary sash and a sash retaining system in accordance with the present invention.

FIGS. 2, 3 and 3*b* illustrate a restraining device 1240 adapted to limit movement of the secondary sash 1100 relative to the primary sash 12. The restraining device 1240 includes a spring slider 1241 configured to slideably mount within the channel 1118 of member 1103. The spring slider 1241 is symmetrically configured to include a pair of posts 1242 and a raised center member 1243 having a pair of overhanging ears 1244. On one end, the spring slider 1241 is connected to first corner lock 1208 at post 1215 by a resilient member 1245, such as a spring. At the other end, the spring slider 1241 is connected to second corner lock 1209 at the center member 1243 by a cord 1246.

The cord 1246 is anchored at a first end in keyhole opening 1214. The cord 1246 then wraps around the center member 1243 of the spring slider 1241 and is restrained from sliding off the center member 1243 by one of the ears 1244. The cord 1246 then extends back to the corner lock 1200 and threads into the one end of the 'L' shaped opening 1213 passing under the overhanging lip 1247 and out the other end. The cord 1246 extends toward and is removably secured at a second end 1249 to a window anchor 1248 mounted to the primary sash 12 or window frame.

When the secondary sash 1100 is closed with respect to the primary sash or window frame, as shown in FIG. 3, the resilient member 1245 is in a generally relaxed configuration with the spring slider 1241 slid toward the first corner lock 1208. In this configuration, the member 1103 of the secondary sash frame 1100 passes under the window anchor 1248 mounted to an underside of the head piece of the window frame, as shown in FIGS. 3 and 3*b*. When the secondary sash 1100 is opened with respect to the primary sash or window frame, as shown in FIG. 2, the cord 1246 extends from the window anchor 1248. As the cord 1246 extends away from the frame 1100, the spring slider 1241 is pulled toward the second corner lock 1209 and the resilient member 1245 is stretched between the spring slider 1241 and the first corner lock 1208.

The restraining device 1240 provides a restraining mechanism to keep the secondary sash 1100 from opening too far. The resilient member 1245 both causes the cord 1246 to be recaptured within the member 1103 upon closing of the frame 1100 and encourages the closing of the frame 1100 with little or no effort on the part of the user opening the secondary sash 1100. Once opened, the second end 1249 of the cord 1246 may be disengaged from the window anchor 1248 so that the secondary sash 1100 may be opened further and/or removed from the primary sash or window frame.

Figure 5:
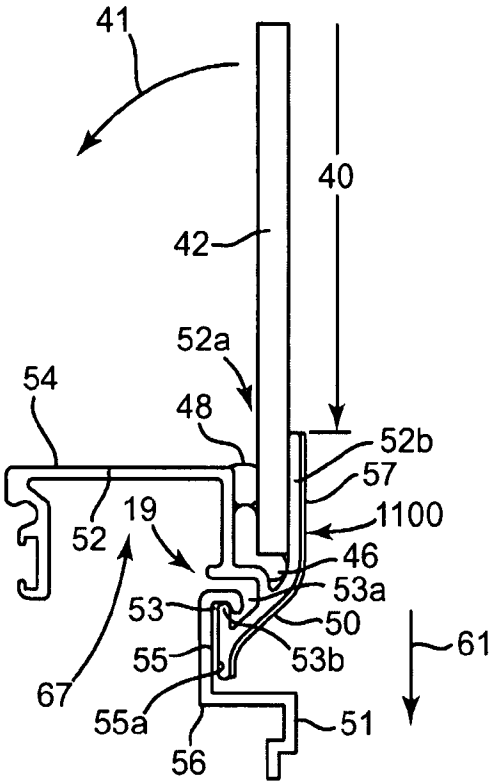
FIG. 5 is fragmentary side sectional view of the secondary sash of FIG. 2.

In another embodiment shown in FIG. 2*a*, the secondary sash 1100 can be removably attached to the primary sash 12. As illustrated in FIG. 2, the secondary sash 1100 is manually, pivotally movable between open and closed positions around hinge 19. As best illustrated in FIG. 5, the hinge 19 is formed from a groove 53*a* of peripheral portion 50 of extrusion 52 and channel 53 of a mounted flange 51.

FIG. 2*a* illustrates an alternate mechanism 71 for limiting movement of the secondary sash 1100 between the open position and the closed position. The mechanism 71 includes an arms 68 operatively connecting the primary sash 12 and the secondary sash 1100. The arm 68 includes a first section 70 and a second section 72 pivotally connected together at point 74.

A lock mechanism 13 for locking the secondary sash 1100 to the primary sash 12 is included in the window assembly 1000. Suitable lock mechanisms are well known in the art as is shown in U.S. Pat. Nos. 4,059,298; 4,095,829; and/or 4,429,910, which are hereby incorporated by reference. In the preferred embodiment, the locking mechanism 13 is shown in detail in the U.S. Patent application entitled Moveable Light Latch (attorney docket no. 301233), filed herewith.

The primary difference between FIGS. 1*a* and 1*b*, FIGS. 2 and 2*a*, and FIGS. 3 and 3*a* is the presence of arm type hinge 80 in FIGS. 1*b* and 3*b*. This feature will be more fully described in connection with FIGS. 13*a*-13*c*

Figure 4:
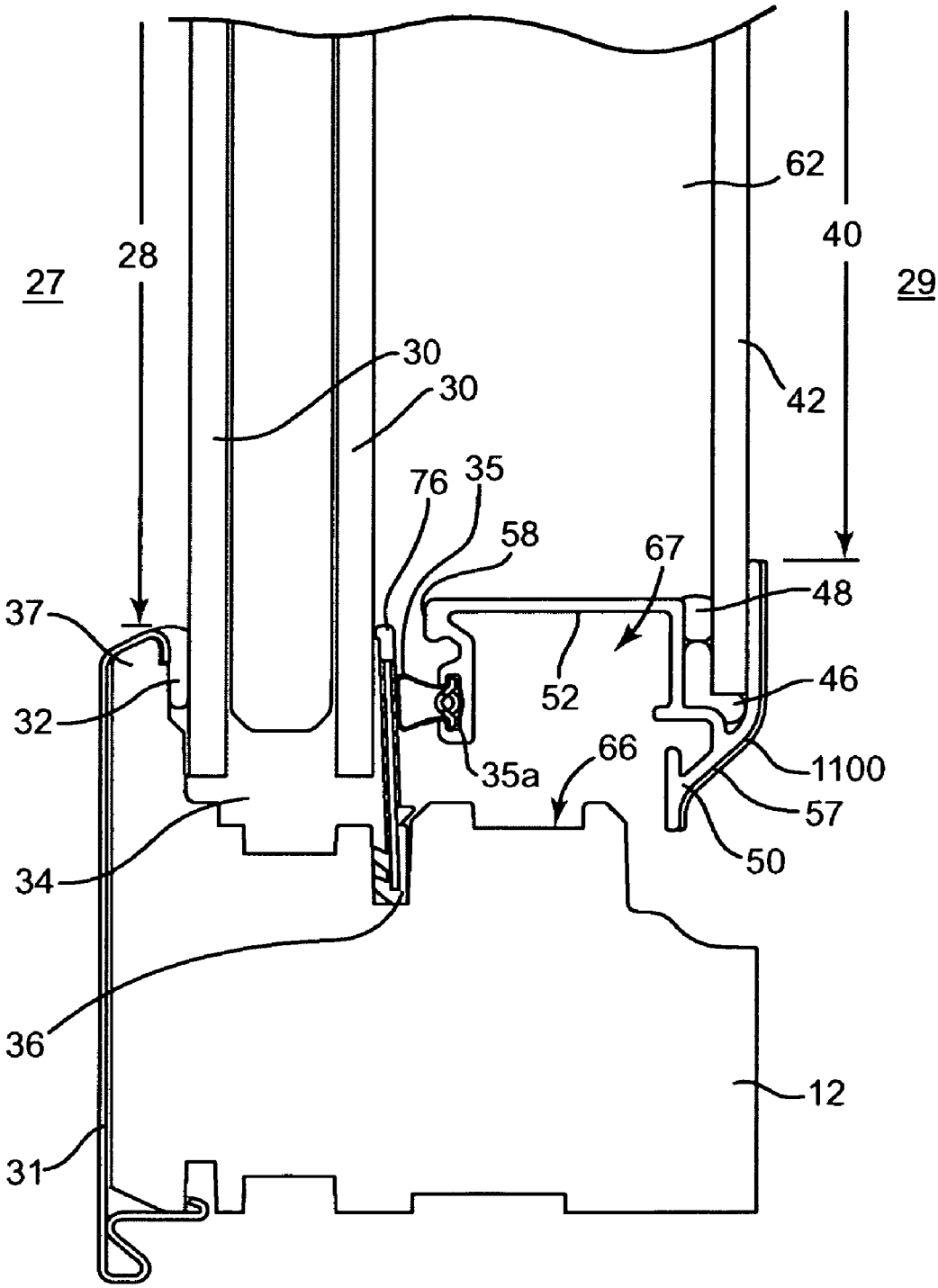
FIG. 4 is a cross-sectional view of the primary and secondary sashes of FIG. 1 taken along line 4-4.

FIG. 4 is a cross-sectional view of the primary sash 12 and the secondary sash 1100 of FIG. 1 taken along line 4-4, with the window frame 16 removed. The primary sash 12 defines a first or primary glazing opening 28. In this embodiment, primary glazing panes 30 are attached to the member 37 using glazing material 32, such as for example silicone. A hot melt adhesive can optionally be used to attach the member 37 to the glazing pane 30. Spacer 36 holds seal 76 against the primary glazing pane 30. The spacer 36 preferably extends along the entire inner perimeter of the primary sash 12. Cladding 31 can be added to the surface of frame 12 to provide a desired look and to add protection to the frame.

Breather channel 34 extends along the inner perimeter of the primary sash 12. During winter conditions, the breather channel 34 carries low humidity outside air to air chamber 62. In one embodiment, the seal 76 includes a serrated edge that interfaces with the interior pane 30 to provide a path for the low humidity air in the breather channel 34 to flow into the air chamber 62. As will be discussed in connection with FIG. 11, the low humidity air enters the breather channel 34 through breather system 1105, or some other suitable mechanism. An alternate breather system suitable for use with the present invention is disclosed in U.S. Pat. No. 5,325,579 (Baier).

Referring to FIGS. 4, 4*a*, 5, and 6, the secondary sash 1100 is constructed from a plurality of rails 52 extending around a perimeter or peripheral portion 50. The rails 52 are preferably made of vinyl or aluminum through extrusion processes, which are commonly known in the window manufacturing industry. Alternatively, wood rails 52 can optionally be milled using conventional techniques.

When the secondary sash 1100 is in the closed position, the extrusions 52 are oriented toward the primary glazing panes 30. Seal 76 is preferably included in the window assembly 1000 to seal the secondary sash 1100 to the primary sash 12. The seal 76 generally extends along the inner perimeter of the first sash 12. The seal 76 can be made of a rigid material, such as for example metal or plastic, or a flexible material such as for example foam, soft plastic, an elastomeric material, such as rubber, or similar materials.

The secondary sash 1100 defines a secondary glazing opening 40. In the illustrated embodiment, a secondary glazing pane 42 is received in a retention groove 44 formed in the secondary sash 1100 to cover the secondary glazing opening 40. The groove 44 extends along the inner perimeter of the secondary sash 1100. Glazing materials 46 (such as for example, butyl mastic) and 48 (such as for example, urethane adhesive) are applied around the perimeter of the secondary glazing pane 42 to hold the secondary glazing pane 42 into the retention groove 44 of the secondary sash 1100.

In the illustrated embodiment, a decorative cover 57 is glued to a surface of extrusion guide flange 52*b* along the perimeter of the peripheral portion 50. The decorative cover 57 can be a coating, such as paint, stain or varnish, or an applique, such as a wood or plastic veneer. The decorative cover 57 can be attached to the extrusion guide flange 52*b* by an adhesive, fasteners, and/or a mechanical interlock, such as a snap-fit relationship.

Referring particularly to FIG. 4, the primary glazing panes 30 are generally positioned adjacent to the exterior 27 of the building structure, while the secondary glazing pane 42 is generally positioned adjacent to the interior 29 of the building structure.

The primary glazing panes 30 and the secondary-glazing pane 42 create an air chamber 62 substantially closed to the interior 29 of the building structure. The seal 76 may cooperate with a gasket 35, held in a gasket receiving slot 35*a* of the extrusion 52 to substantially seal off the air chamber 62 from external spaces. As will be discussed below in connection with FIG. 11, the air chamber 62 preferably includes a breather system 1105 that permits air at the exterior 27 of the building structure to enter the air chamber 62.

The primary sash 12 includes a recessed region 66 formed in at least a portion of the primary sash 12 along the inner perimeter. An accessory channel 67 is located along at least a portion of the outer perimeter of the secondary sash 1100. As used herein, "accessory channel" refers to a space or cavity located in one or more secondary sash members that is adapted to receive and contain at least a portion of a window accessory. The present accessory channels 67 are preferably located between the air chamber 62 and the region 66 on the primary sash 12, without interfering with the operation of the secondary sash 1100. Access to the accessory channel 67 is typically through the perimeter edge of the secondary sash 1100, but may be from any side. As will be discussed below, the secondary sash members 1101, 1102, 1103, 1104 optionally include openings along the edge opposite the air chamber 62 to provide access to the accessory channels 67.

The accessory channel 67 can be used for receiving one or more window accessory operating mechanisms, such as for example the shade operator disclosed in commonly assigned U.S. Patent applications entitled Shade Drive System (attorney docket no. 306547), filed herewith. The details of the operating mechanisms will be discussed below. In the illustrated embodiment, the accessory region 67 has generally a "U" shape.

Figure 4A:
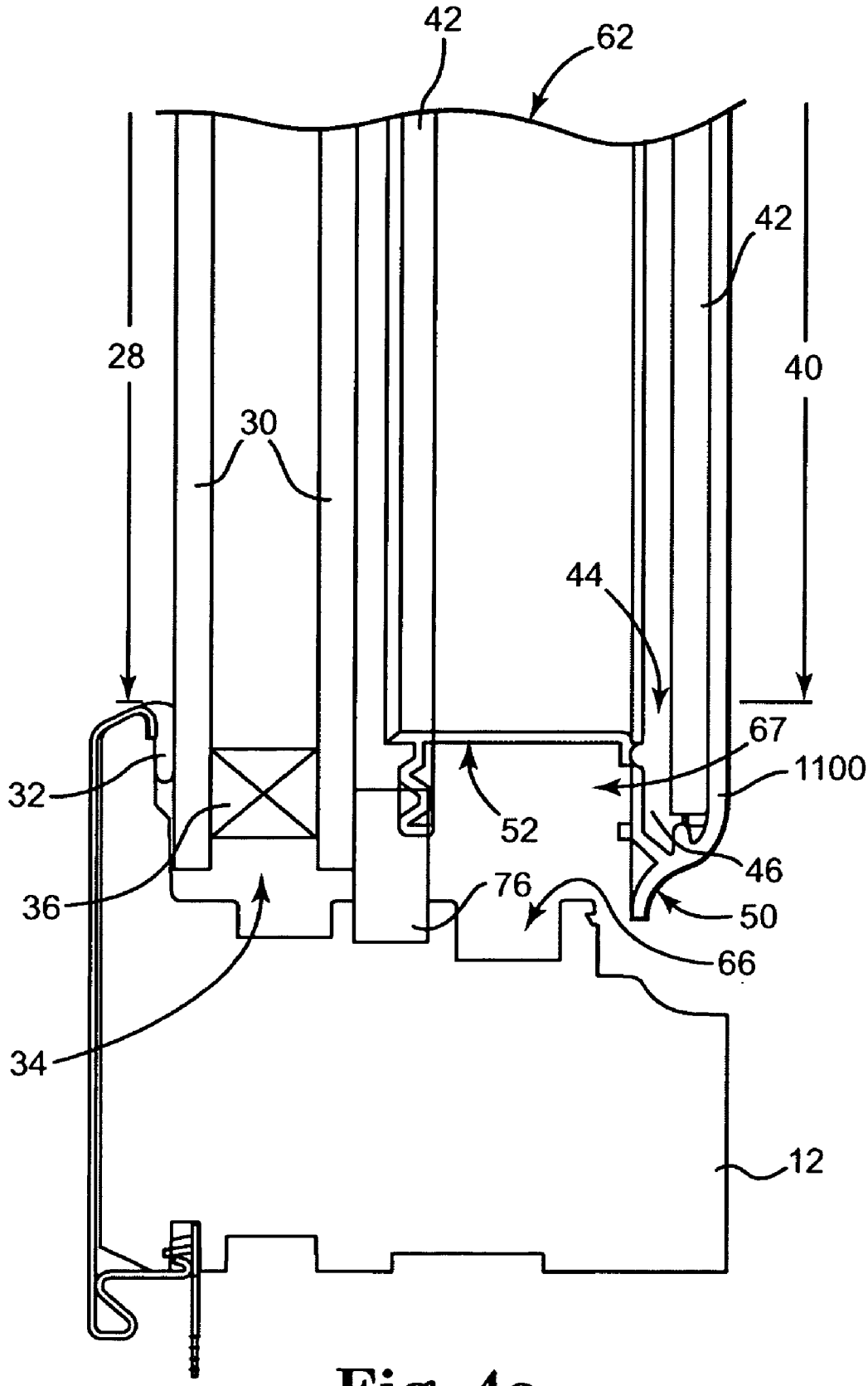
FIG. 4*a* is a cross-sectional view of the primary and secondary sashes of FIG. 1*b* taken along line 4-4.
Figure 6:
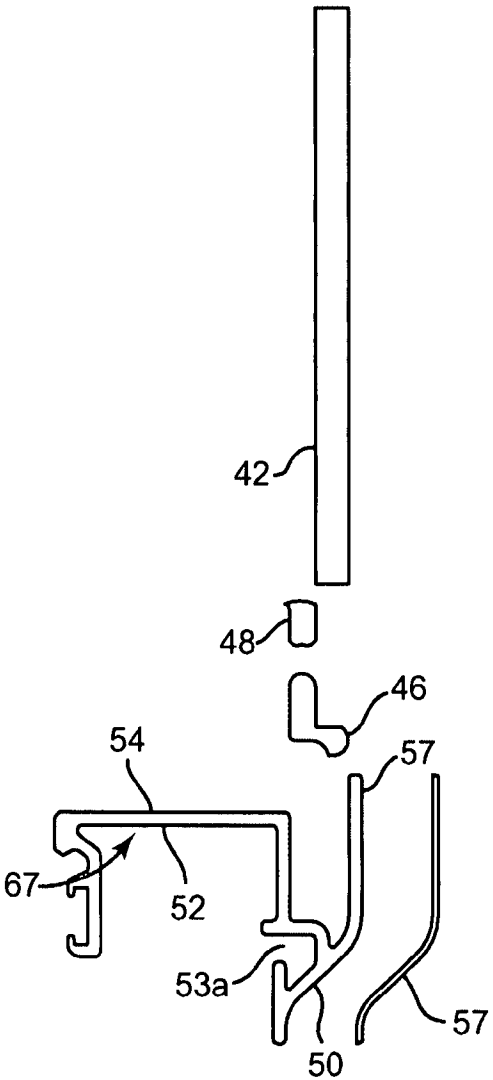
FIG. 6 is fragmentary exploded side sectional view of the secondary sash of FIG. 2.

In the illustrated embodiment, the peripheral portion 50 and the extrusion portion 52 is substantially covered by the region 66 on the primary sash 12 when the secondary sash 1100 is in the closed position. The extrusion 52 may also include a clip region 58 for connection of a muntin bars system to the secondary sash 1100, such as those discussed in connection with FIGS. 14*a*-*d* below. In the illustrated embodiment, the clip region 58 includes a groove 59 formed in the extrusion 52 FIG. 4*a* shows an alternate embodiment of the window assembly of FIG. 4 where a secondary sash 1100 is formed with two glazing panes 42 and a different structure for seal 76 is shown. In this embodiment, the seal 76 may be formed of a resilient material such as a rubber gasket or other well know materials.

FIG. 5 shows the secondary sash 1100 open approximately 90 degrees relative to mounting flange 51 and the primary sash 12 (not shown). The mounted flange 51 includes a U-shaped channel 53. The U-shaped channel 53 cooperates with channel 53*a* and edge 53*b* on the peripheral portion 50 of the extrusion 52 to provide the hinge 19. The edge 53*b* rotates in the U-shaped channel 53 to rotate in the direction 41. Engagement of the surfaces 55 and 55*a* acts as a stop when the hinge 19 is opened about 90 degrees. When in the open position illustrated in FIG. 5, the secondary sash 1100 can be shifted in the direction 61so that the edge 53*b* is clear of the U-shaped groove 53, and the secondary sash 1100 can be disengaged from the mounting flange 51.

Secondary pane 42 is placed into glazing channel 52*a* between extrusion extension 54 and extrusion guide flange

52*b*. The glazing panel 42 is held in place with glazing material 46, 48. The extrusion guide flange 52*b* also substantially covers the gap between the primary sash 12 and the secondary sash 1100 when the secondary sash 1100 is closed.

Figure 7:
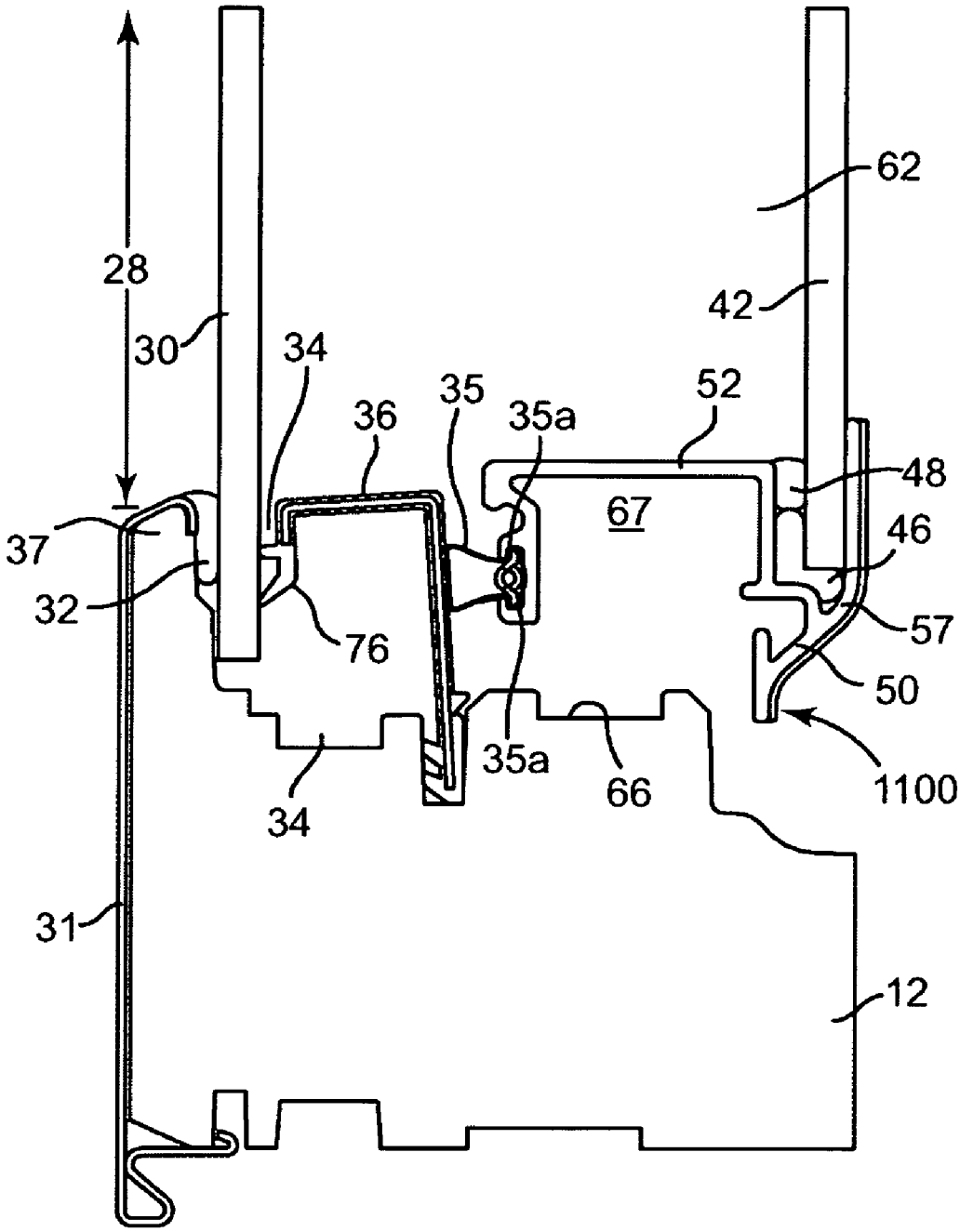
FIG. 7 is a fragmentary side sectional view of primary and secondary sashes of a window assembly in accordance with the present invention.

FIG. 7 illustrates another embodiment of the window assembly 1000 in accordance with the present invention. In this embodiment, a single primary glazing pane 30 is attached to the member 37 using glazing material 32, such as for example silicone. Spacer 36 holds seal 76 against the primary glazing pane 30. The spacer 36 may extend along the inner perimeter of the primary sash 12. The seal 76 optionally includes openings, such as a serrated edge along the inner surface of the pane 30, to permit low humidity outside air in the breather channel 34 to enter the air chamber 62.

The secondary sash 1100 of FIG. 7 is included in the window assembly 1000 in the same or a similar manner as described for the secondary sash 1100 shown in FIG. 4*b*. A secondary glazing pane 42 is received in the secondary sash 1100. A gasket 35 is located between the spacer 36 and the frame 52 of the secondary sash 1100.

Figure 8:
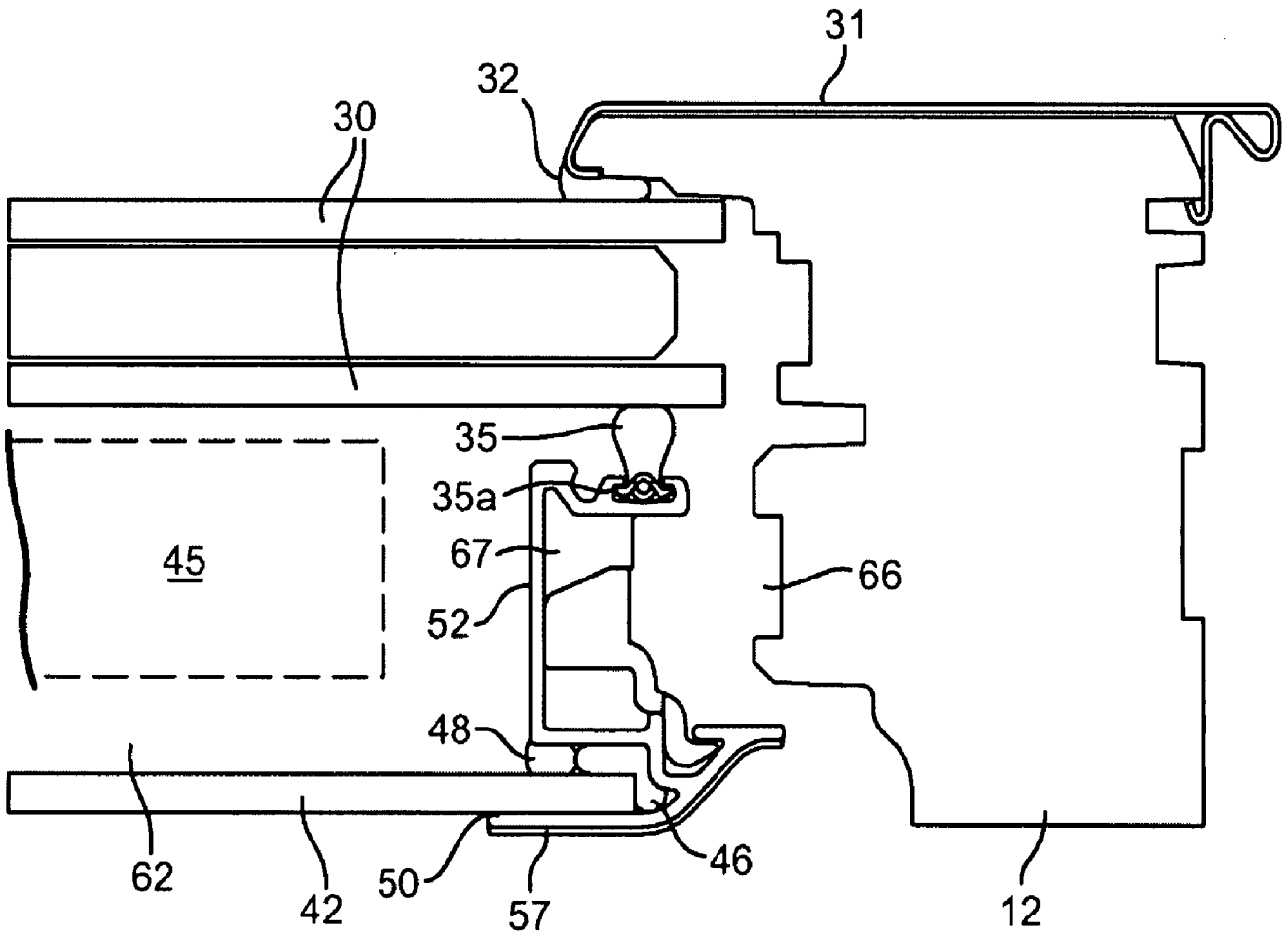
FIG. 8 is a side sectional view of the primary and secondary sashes of the window assembly of FIG. 1 with a window accessory.

Referring to FIG. 8, one or more window accessories (e.g., a grid, a grille, a shade, a screen, a blind, and a window fashion) can be placed in the air chamber 62 between the primary glazing panes 30 and the secondary glazing pane 42. In the illustrated embodiment, a blind 45 is shown schematically in the air chamber 62. One or more accessory operating mechanisms for operating the window accessories (e.g. the blind 45) can be placed in the accessory channel 67 of the secondary sash 1100. Suitable accessory operating mechanisms can be found in U.S. Pat. Nos. 5,934,351, 4,934,438 and/or 4,913,213, all of which are incorporated herein by reference.

Figure 9:
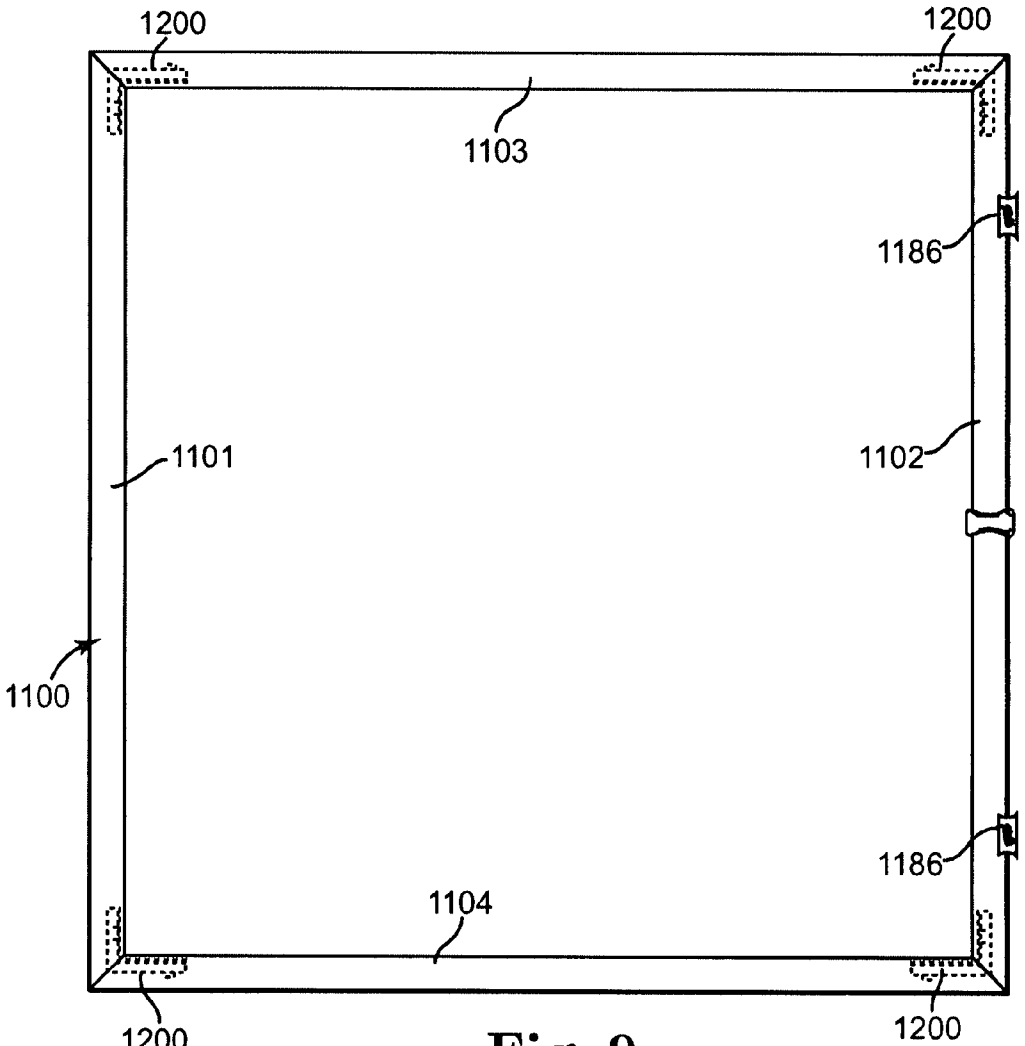
FIG. 9 is a front view of the secondary sash of FIG. 2 with corner locks.
Figure 10:
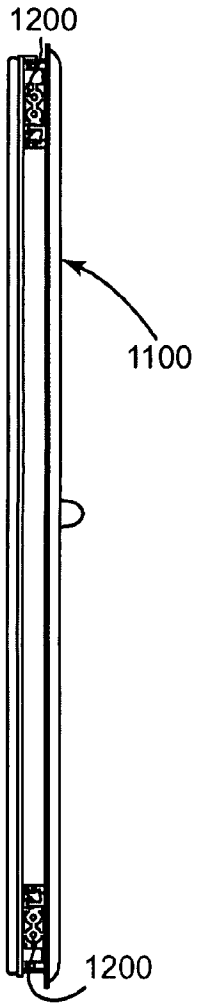
FIG. 10 is a side view of the secondary sash of FIG. 2 with corner locks.

Referring to FIGS. 9 and 10, the secondary sash 1100 of the window assembly 1000 can be seen. In the illustrated embodiment, the secondary sash 1100 is made of four sash members 1101, 1102, 1103, and 1104. The window assembly 1000 typically includes corner locks 1200, which are fasteners for use in joining and securing the sash members 1101, 1102, 1103, 1104 together. Corner locks 1200 are well known in the window and door construction industry. Typically, each of the sash members 1101, 1102, 1103, 1104 has a 45° miter. When the sash members 1101, 1102, 1103, 1104 are brought together, a 90° corner is formed.

The corner locks 1200 function to both secure the two sash members 1101, 1104 together and to properly align the sash members, so that the two sash members 1101, 1104 are properly aligned along their 45° miters so as to form a true 900 angle when the sash members 1101, 1102, 1103, 1104 are secured to each other. The joint angles do not necessarily have to be 90°. The joint angles could be 105 °, 70 °, 150°, etc. with corresponding miter angles of one-half of the joint angle. The secondary sash 1100 does not necessarily have to be rectangular and does not necessarily have to be made of four sash members 1101, 1102, 1103, 1104. The shape of the secondary sash 1100 generally corresponds to the shape of the primary sash 12.

Figure 11:
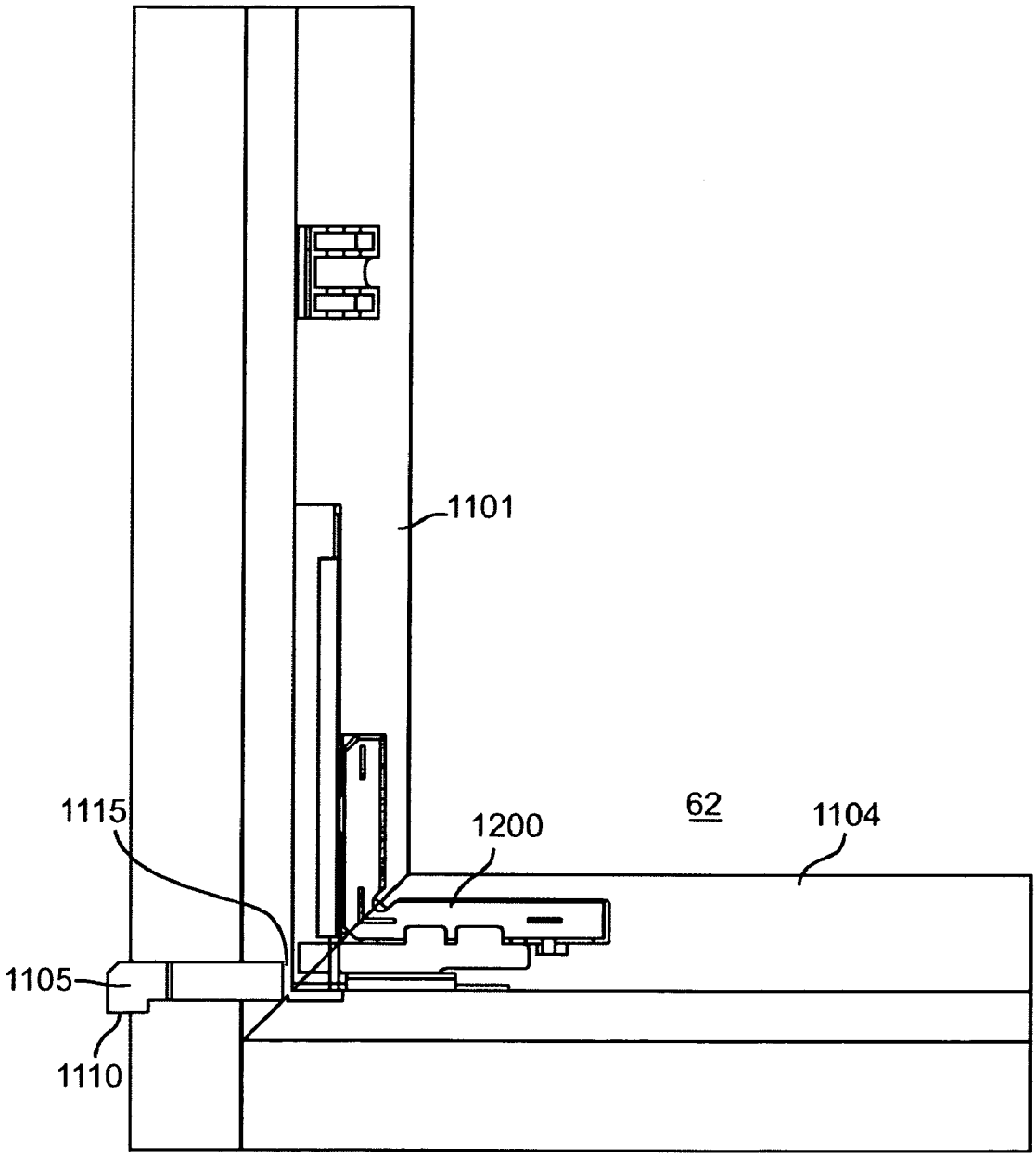
FIG. 11 is a fragmentary front sectional view of the primary and secondary sashes of FIG. 2, where the secondary sash is in its closed position.

Referring to FIG. 11, the window assembly 1000 preferably includes a breather system 1105 with a downward oriented opening 1110 that provides an air passage extending between the air chamber 62 and the exterior of the building structure, so that the air chamber 62 can communicate with outside air. (See also FIG. 1.) Breather systems are well known in the window and door construction industry. In the winter, the breather system 1105 can effectively prevent excessive moisture build-up, which results in condensation on an inner surface of the primary glazing pane 30. Consequently, the air chamber 62 is substantially closed to the interior of the building structure, but not the exterior of the building structure.

Figure 12:
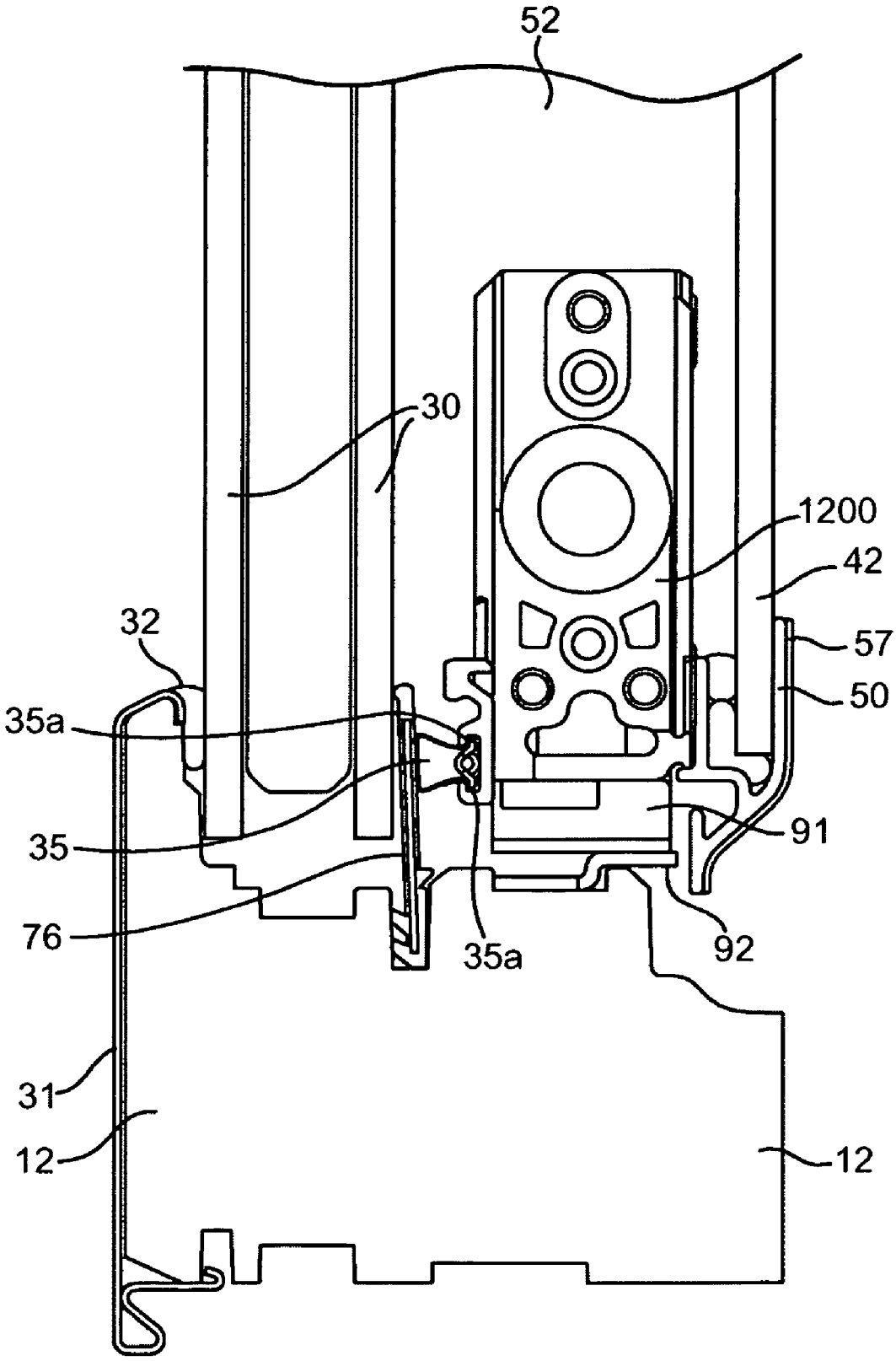
FIG. 12 is a fragmentary side sectional view of the primary and secondary sashes of FIG. 2 showing a corner lock, where the secondary sash is in its closed position.

Referring now to FIG. 12, there shown is a larger view of the embodiment of the window assembly shown in FIG. 1*a*. The corner lock 1200 holds together portions of the secondary sash frame. Plastic member 91 attached to the corner lock 1200 abuts stainless steel support plate 92 to provide a bearing surface from which hinge 19 can operate (see FIGS. 5 and 6). The support plate 92 further assists in maintaining the hinging relationship between the mounted flange 51, groove 53*a* and edge 53b. In one embodiment, a sealant is injected between the corner lock 1200 and the extrusion 52.

Figure 13A:
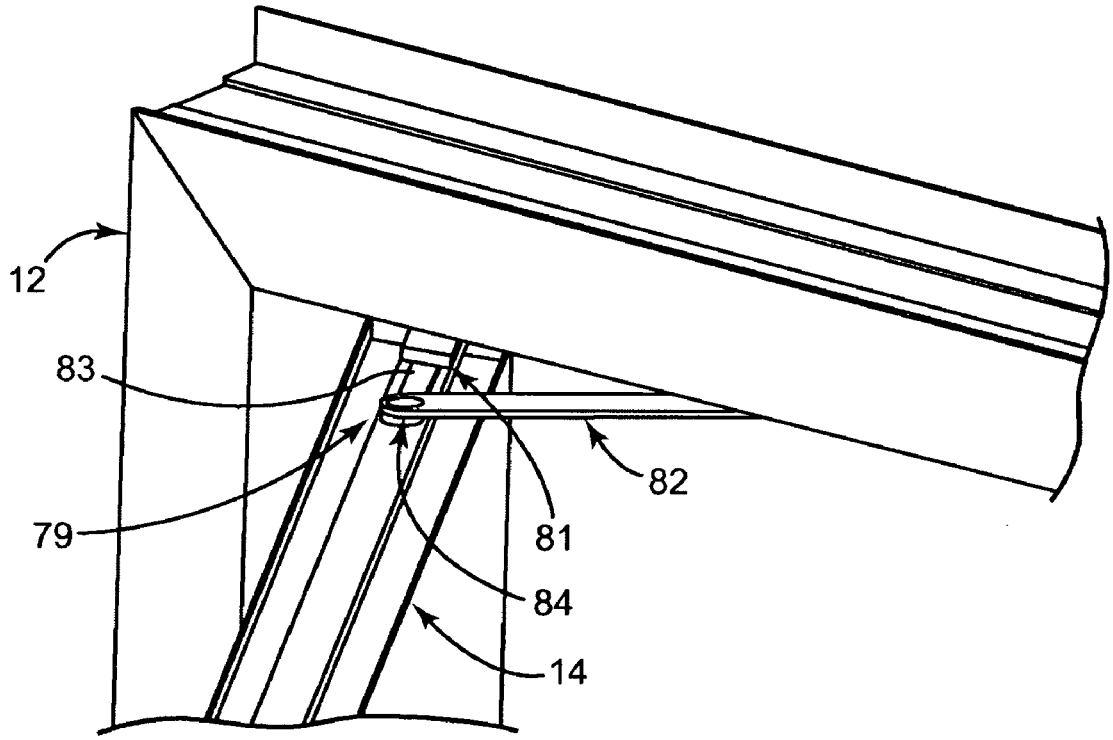
FIGS. 13*a*, 13*b* and 13*c* are perspective views of the primary and secondary sashes of FIG. 1*b* in the open position.
Figure 13B:
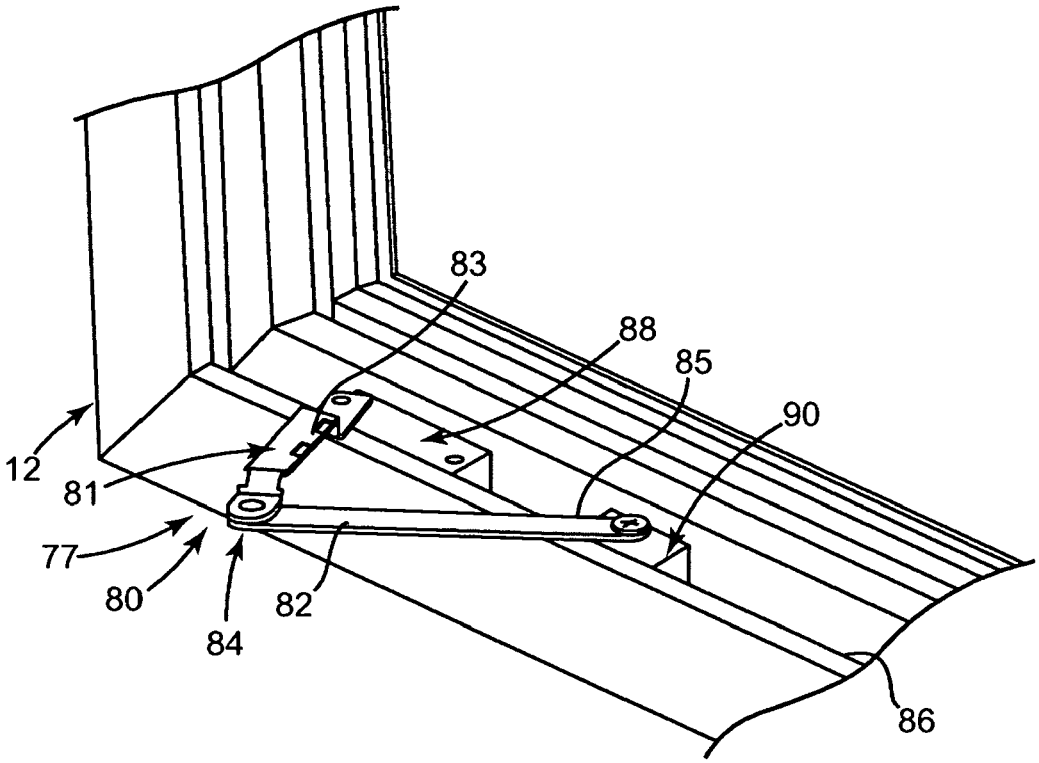
Figure 13C:
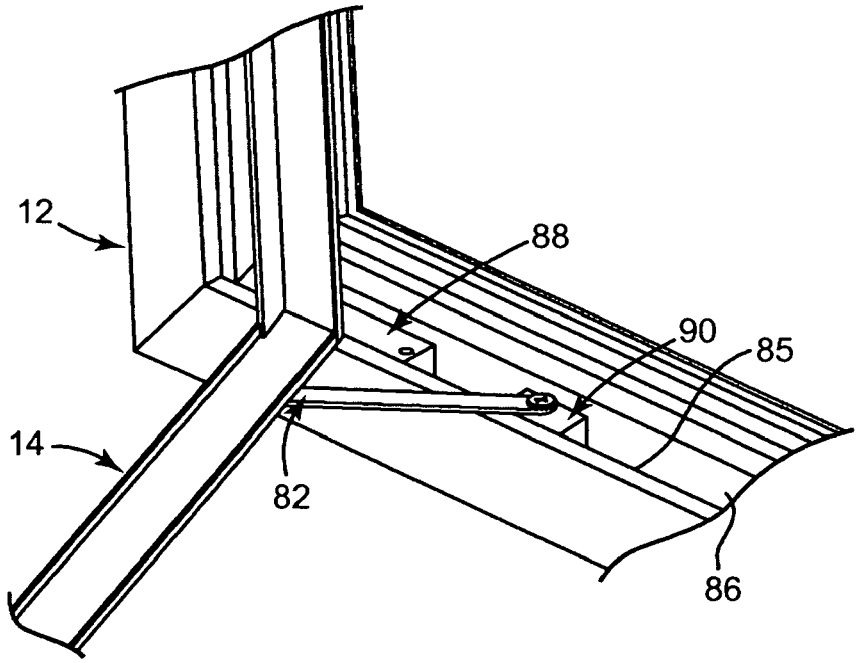

Referring now to FIGS. 13*a*-13*c*, there shown are perspective views of an alternate hinge mechanism 79 pivotally attaching the secondary sash 1100 to the primary sash 12. As illustrated, hinge mechanism 79 may be located at the top, bottom or sides of the secondary sash 1100. Hinge mechanism 79 includes a plurality of arms 81, 82 operatively connecting the primary sash 12 to the secondary sash 1100. The arms 81 and 82 are connected at hinge point 84. In the illustrated embodiment, arm 81 has a ledge section 83 adapted to be received in recess 85 in the secondary sash 1100. Arm 81 is retained in the recess 85 and rotates or swings with the secondary sash 1100, hidden from view.

FIG. 13*b* shows the hinge mechanism 79 without the secondary sash 1100 for clarity. First section 82 is pivotally coupled to a first block 90. First block 90 is stationary and resides in a recess 86 extending along the inner periphery of the primary sash 12. Second section 81 is pivotally coupled to a second block 88 residing in and slidable along recess 86. When the secondary sash 1100 is in a closed position, the second block 88 is longitudinally displaced from the first block 90. The secondary sash 1100 overlays the recess 86, blocking the hinge mechanism 79 from view. When the secondary sash 1100 is moved into an open position, second block 88 slides proximally toward first block 90 within recess 86. Blocks 88 and 90 are sized so that second block 88 contacts stationary first block 90 when the secondary sash 1100 forms a 90° angle with respect to the primary sash 12. Contact between block 88 and 90 prevents further opening of the secondary sash 1100.

The hinge mechanism 79 thus functions as a stop to prevent over-travel of the secondary sash 1100, which condition can sometimes cause damage to the secondary sash 1100 or window accessories. In other embodiments, the blocks 88 and 90 are sized to permit maximum travel of the secondary sash 1100 to an angle of 45°, 60° or 130° with respect to the primary sash 12. Chamber 62 between the primary glazing panes 30 and secondary glazing pane 42 is thus accessible when the secondary sash 1100 is in an open position, allowing easy cleaning of the primary and secondary glazing panes 30, 42 and access to the window accessory 45 (see FIG. 8).

Figure 14A:
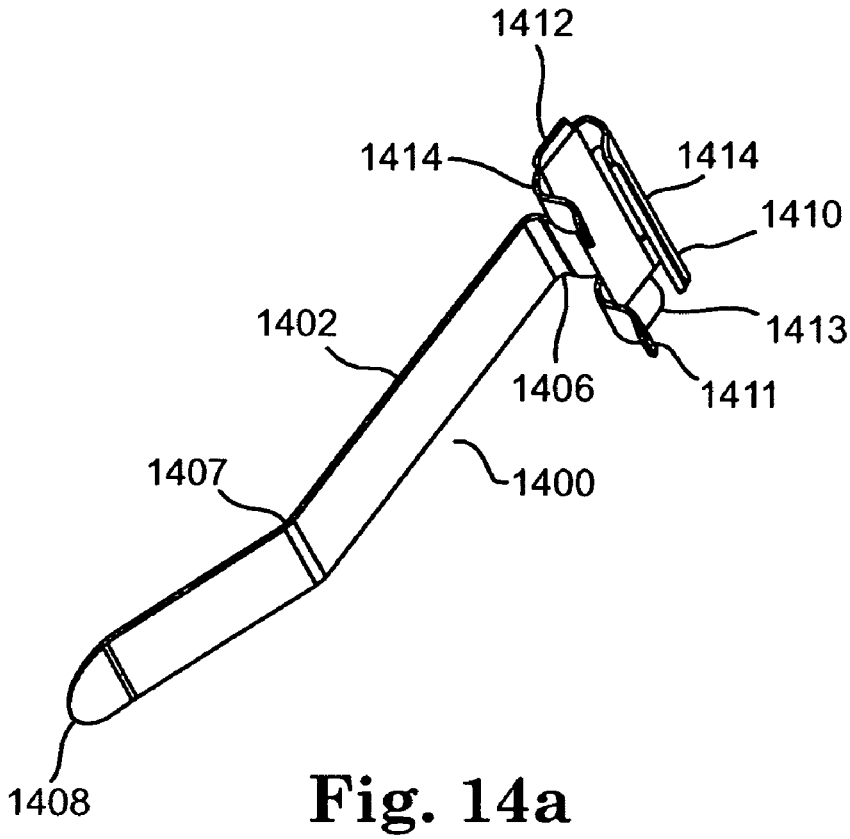
FIGS. 14*a* and 14*b* are top and bottom perspective views 1 5 respectively of a muntin bar clip in accordance with the present invention.
Figure 14B:
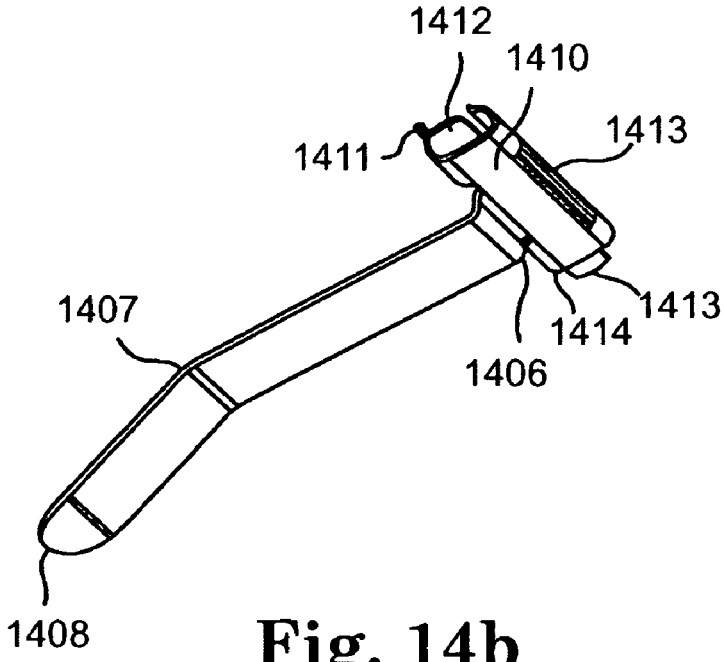

FIGS. 14*a* and 14*b* are top and bottom perspective views respectively of a muntin bar clip 1400 of the present invention. The clip 1400 includes head 1410 and tail 1402. The head is formed of connector portion 1413, first finger 1411, second finger 1412 and spring region 1414. The first and second fingers oppose the spring region to provide a clamping force that is used to engage a portion of the window frame.

The tail 1402 includes an elongated portion ending in a distal tip 1408 and a connector region 1406 for connection of the tail to the head 1410. Intermediate the distal tip and the connector region is a bend 1407 that provides a spring force to hold the clip in place when placed in opening 1451 of muntin bar 1450.

Figure 14C:
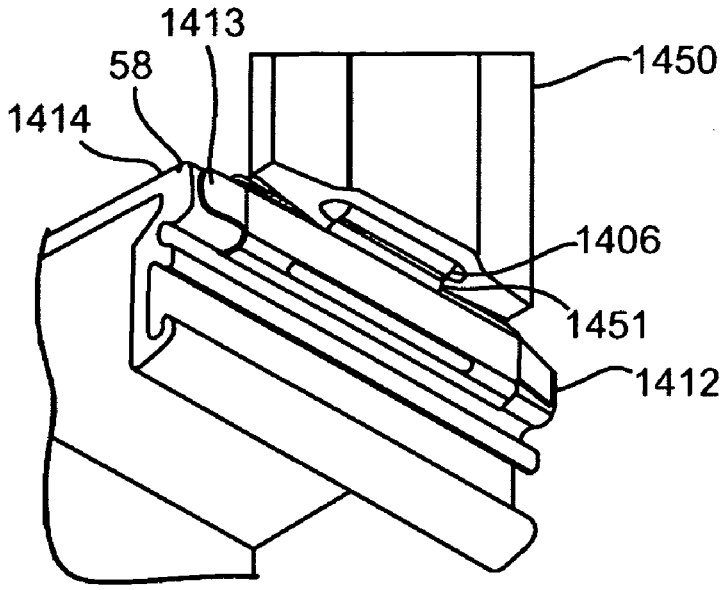
FIGS. 14*c* and 14*d* are bottom perspective and side views respectively of the muntin bar clip attached to a frame of a secondary sash in accordance with the present invention.
Figure 14D:
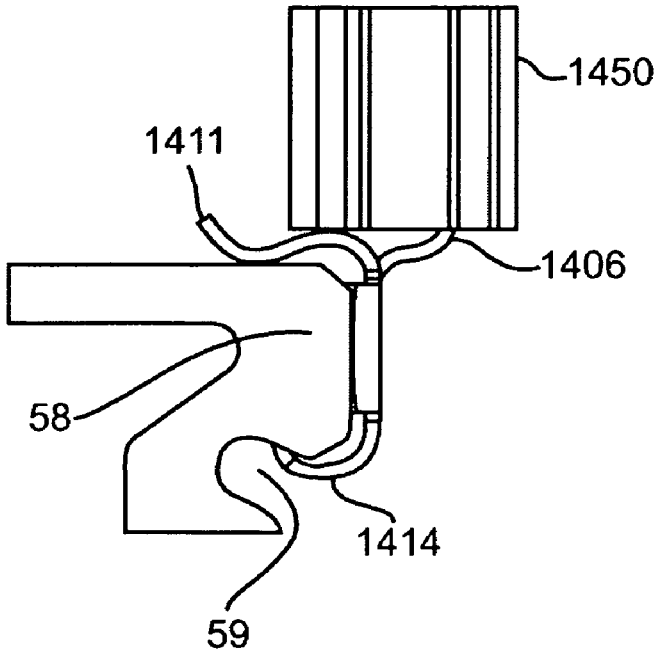

Referring now to FIGS. 14*c* and 14*d*, there shown are a bottom perspective and side view respectively of the muntin bar clip 1400 attached to the region 58 on the secondary sash 1100. In operation, the tail 1402 of clip 1400 is inserted into the muntin bar 1450 at opening 1451. The head 1410 is then placed in proximity to clip region 58 of the secondary sash 1100 to which the muntin bar 1450 is to be attached. It is important to note that the muntin bar 1450 may be attached to either the primary sash 12 or secondary sash 1100 and there may be multiple and crossing muntin bars 1450 attached. First finger 1411 and second finger 1412 engage the clip region on one side while spring region 1414 engages grove 59 to hold the clip 1400 and the muntin bar 1450 in place. In the illustrated embodiment, the clip 1400 mechanical couples to the extrusion 52 in a snap-fit relationship. As used herein, "snap-fit" refers to elastic deformation of one or more of the member forming the mechanical coupling.

Figure 15A:
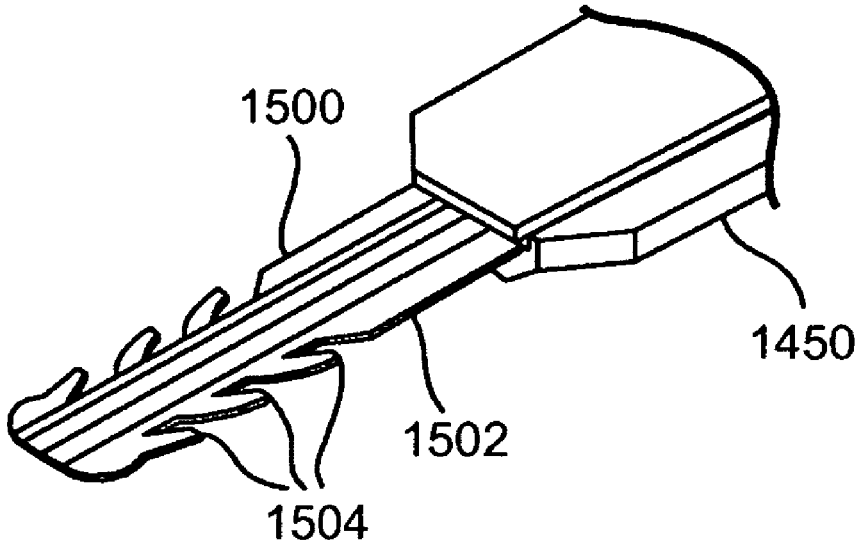
FIGS. 15*a*, 15*b*, 15*c* and 15*d* are views of a muntin bar connector and a muntin bar assembled using the connector in accordance with the present invention.
Figure 15B:
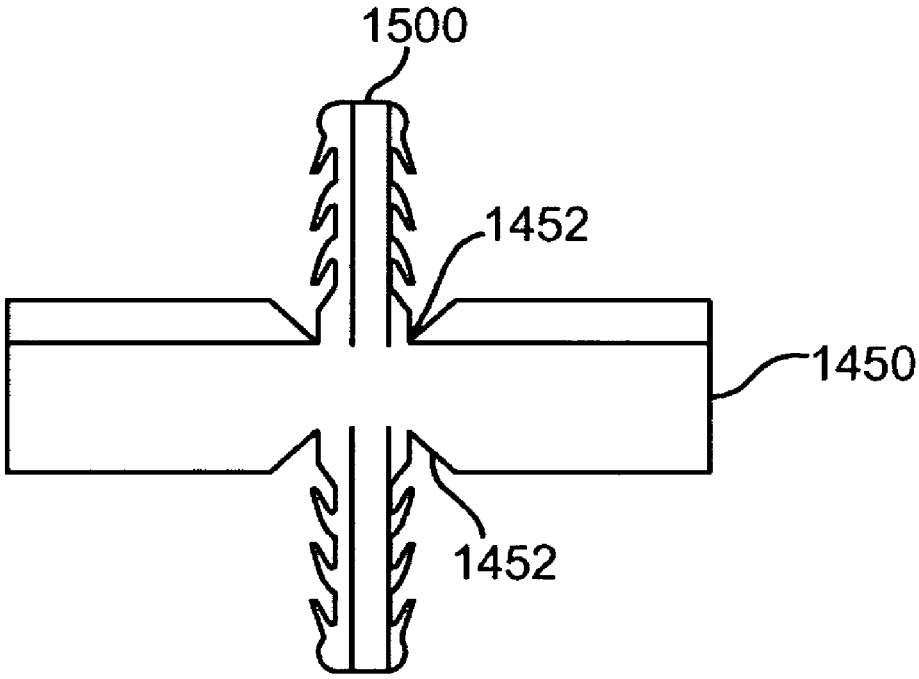
Figure 15C:
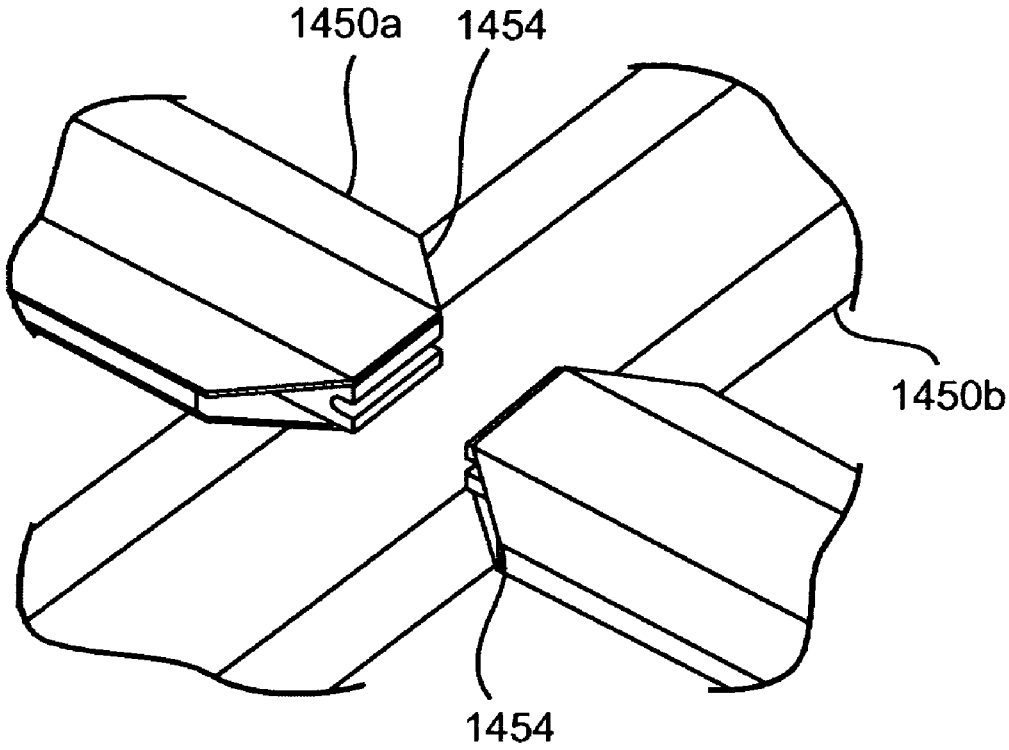
Figure 15D:
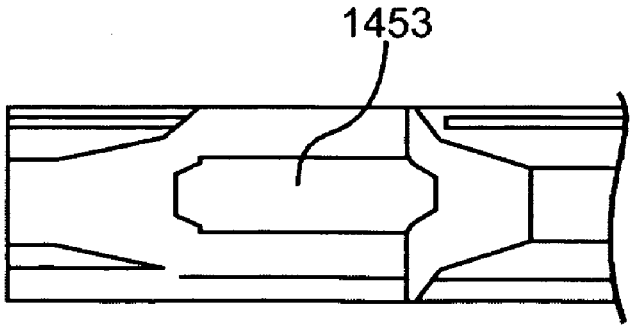

FIGS. 15*a*-15*d* are various views of a muntin bar connector 1500 and crossed muntin bars assembled using the connector. Connector 1500 includes body portion 1502 and fingers 1504. The connector is sized to fit in opening 1451 of a the muntin bar 1450. The opening 1451, in one embodiment, runs the entire length of the muntin bar 1450. Fingers 1450 can be formed to be resilient and to provide a spring force at the inner surface of opening 1451 to hold the connector in place. In FIGS. 15*b* and 15*d*, a connector 1500 is shown being placed in an opening 1453 in a muntin bar 1450 to form a cross connection. The opening 1453 is formed in a narrowed region 1452 of the muntin bar 1450 to mate with narrowed regions 1454 as shown in FIG. 15*c*.

Figure 16:
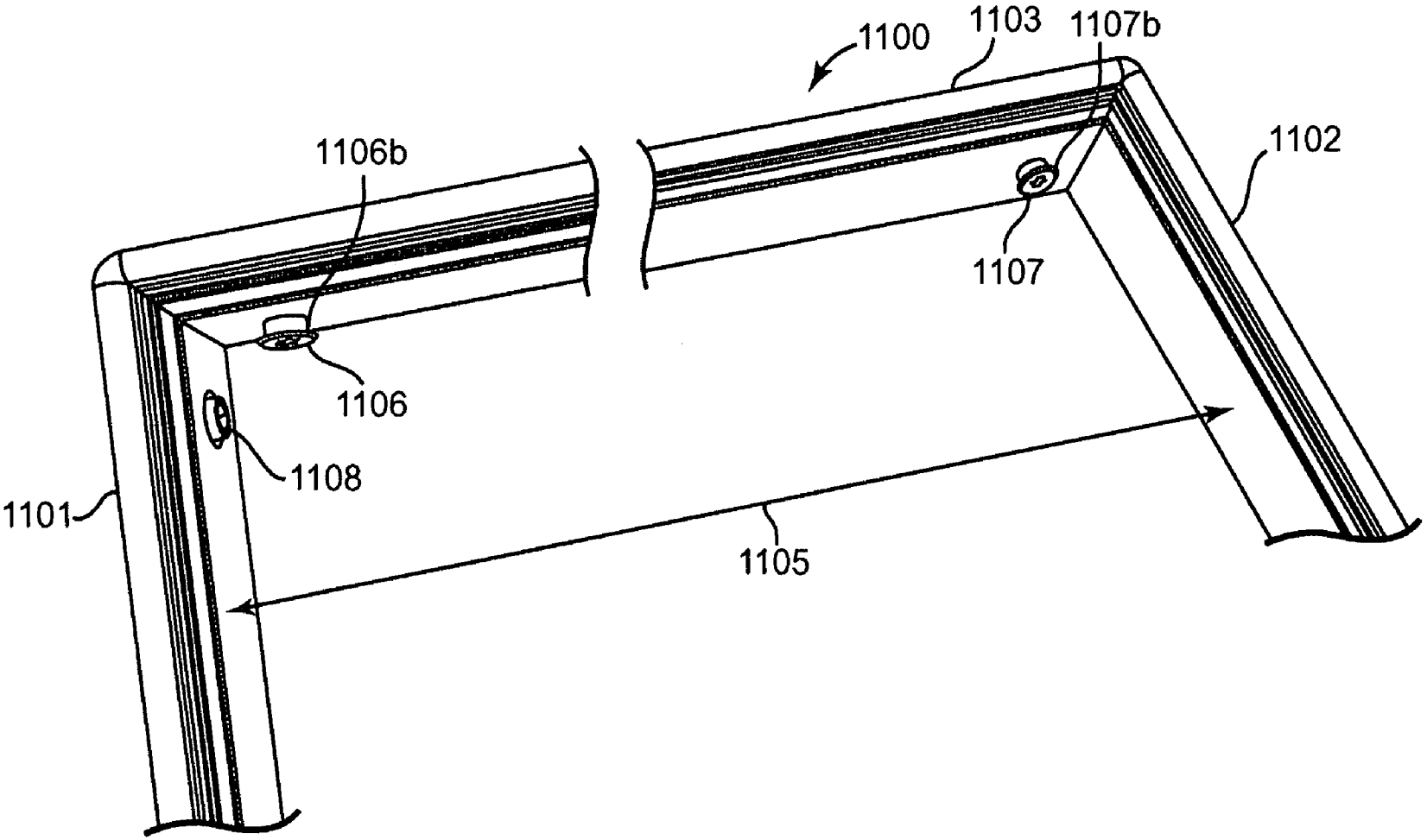
FIG. 16 is a bottom left perspective view from the exterior of a frame of a secondary sash showing mounting posts for a blind or shade unit in accordance with the present invention.

FIG. 16 is a bottom left perspective view of a frame of a secondary sash 1100 showing mounting posts 1106, 1107 for a blind or shade unit attached to member 1103. The mounting posts 1106, 1107 may also be used for other accessories. The mounting posts 1106, 1107 are for illustration purposes only. A variety of mechanical coupling structures can be provided to couple with window accessories. The mounting posts 1106, 1107 include plates 1106*b*, 1107*b*, respectively. The first frame side 1101 includes a drive opening 1108 adapted to couple to a drive mechanism for a shade (see FIG. 17).

Figure 17:
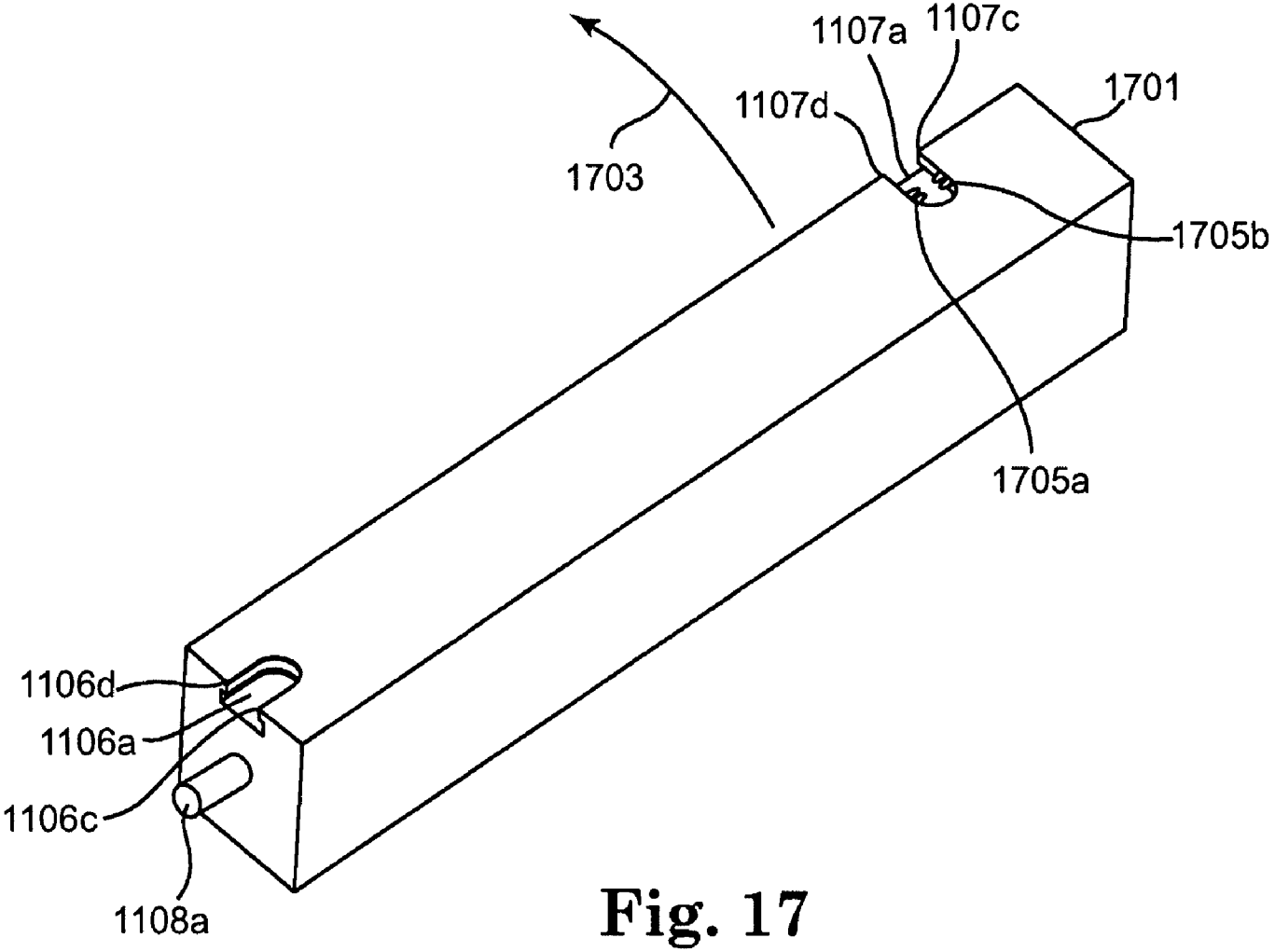
FIG. 17 is a top left perspective view from the exterior of a header for a shade or blind unit in accordance with the present invention.

FIG. 17 illustrates shade mechanism housing 1701 for a shade product that includes mounting slots 1106*a* and 1107*a*, and drive coupler 1108*a*. In the illustrated embodiment, the mounting slot 1106*a* extending generally parallel to an axis of the shade mechanism housing 1701 and the mounting slot 1107*a* is generally perpendicular to the axis of the shade mechanism housing 1701. In an alternate embodiment, both slots 1106*a* and 1107*a* are generally perpendicular to the axis of the shade mechanism housing 1701.

To releasably attach the shade mechanism housing 1701 to the member 1103, slot 1106*a* on the shade mechanism housing 1701 is slidingly engaged with the mounting post 1106. The depth of the slot 1106*a* is sufficient so that the drive coupler 1108*a* engages with the drive opening 1108 on the first frame side 1101. The shade mechanism housing 1701 is then rotated in a direction 1703 until the mounting post 1107 slidingly engages with the slot 1107a. The mounting posts 1106, 1107 provide lateral constraint while the plates 1106*b*, 1107*b* support the weight of the shade mechanism housing 1701. In the illustrated embodiment, the drive opening 1108 is tubular structure with a hexagonal inner profile and the drive coupler 1108*a* is a hexagonal shaft, although a variety of other shapes can be used.

In one embodiment, the slots 1106*a*, 1107*a* are formed with a base portion 1106*c*, 1107*c* that is sized to engage with the plates 1106*b*, 1107*b* and the mounting posts 1106, 1107, respectively. Overhangs 1106*d*, 1107*d* are formed to securely hold the shade mechanism housing 1701 to the posts 1106 and 1107. First and second detent portions 1705*a* and 1705*b* are optionally located in the slot 1107 to releasably engage with the mounting post 1107. For example, the first and second detents 1705*a*, 1705*b* are be formed by placement of spring structures (such as a resilient materials or springs) on one or both sides of the channel.

Figure 17A:
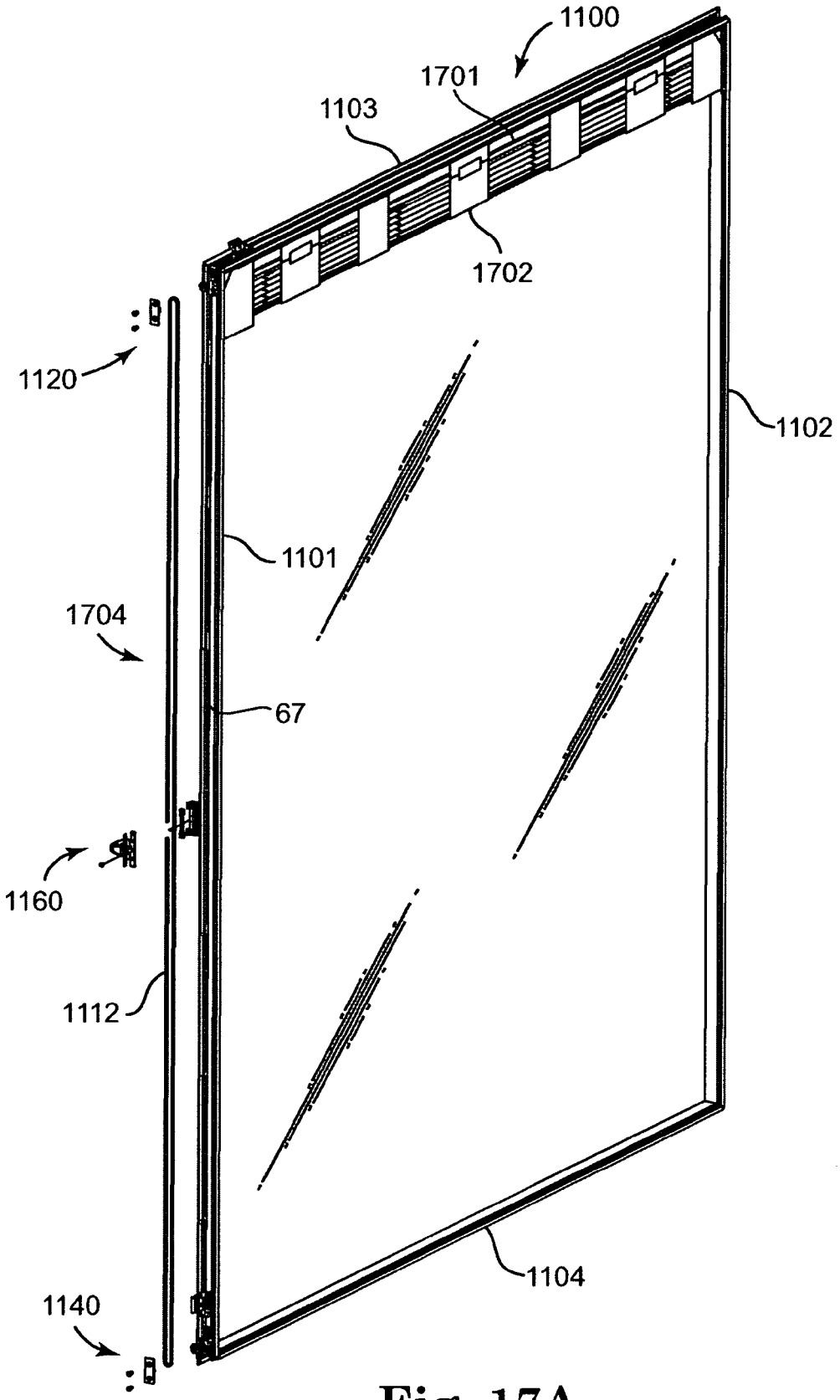
FIG. 17*a* is a perspective view of the mechanism FIG. 17 engaged with a secondary sash in accordance with the present invention.

FIG. 17*a* is a perspective view of the shade mechanism housing 1701 of FIG. 17 engaged with the secondary sash 1100 of FIG. 16. The shade mechanism housing 1701 is engaged with the secondary sash 1100 as discussed above. Window covering 1702 is suspended below the shade mechanism housing 1701. The drive coupler 1108*a* extends through the drive opening 1108 in first frame side and engages with the drive system 1704.

Figure 17B:
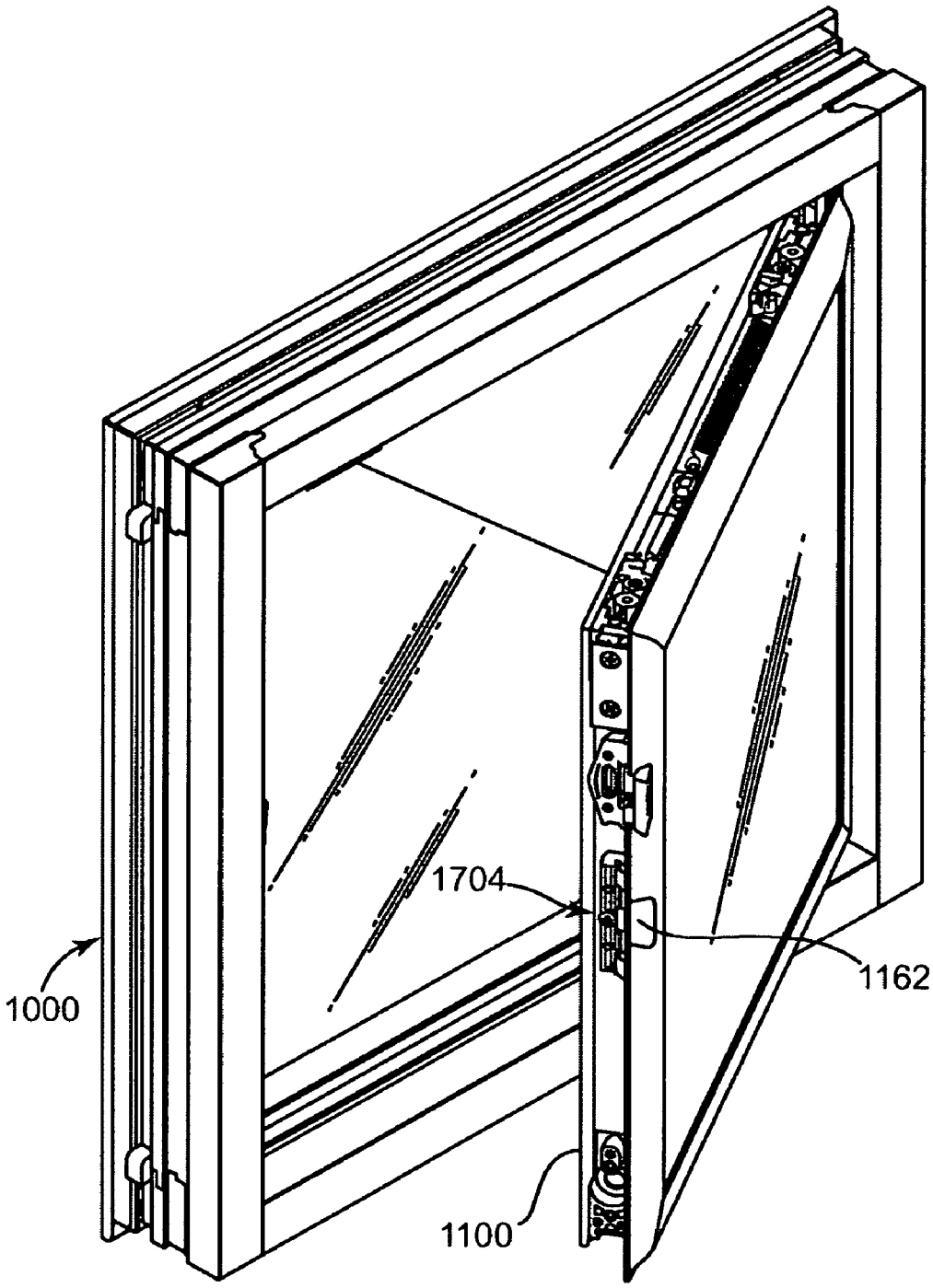
FIG. 17*b* illustrates the secondary sash 11 of FIG. 17*a* mounted to a primary sash in accordance with the present invention.

In the illustrated embodiment, the drive system 1704 includes timing pulley assembly 1120, drive belt 1112 and idler pulley assembly 1140. The drive system 1704 is substantially contained in the accessory channel 67 formed in the secondary sash member 1101 (see FIG. 3*c*). Operator assembly 1160 is attached to the drive belt 1112 and slides up and down in the secondary sash member 1101. Window covering 1702 can be raised, lowered, and/or tilted by moving the operator assembly 1160 along the secondary sash member 1101. FIG. 17*b* illustrates the secondary sash 1100 of FIG. 17*a* mounted in the window frame 1000 of FIG. 1 with the drive system 1704 visible. When the secondary sash 1100 is in the closed configuration, the operator handle 1162 is preferably accessible.

Figure 18:
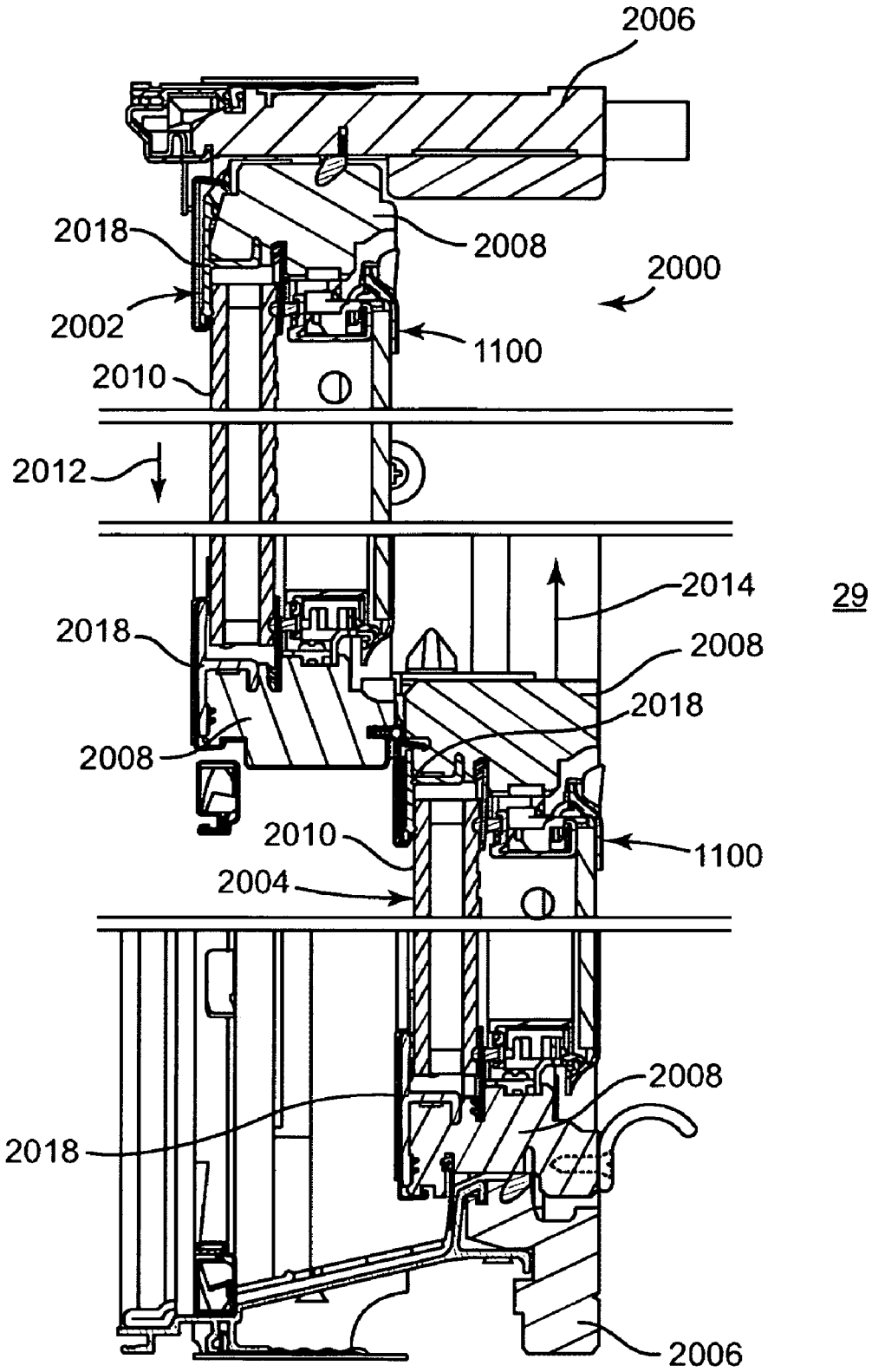
FIG. 18 is a side sectional view of a double hung window with a secondary sash in accordance with the present invention.
Figure 19:
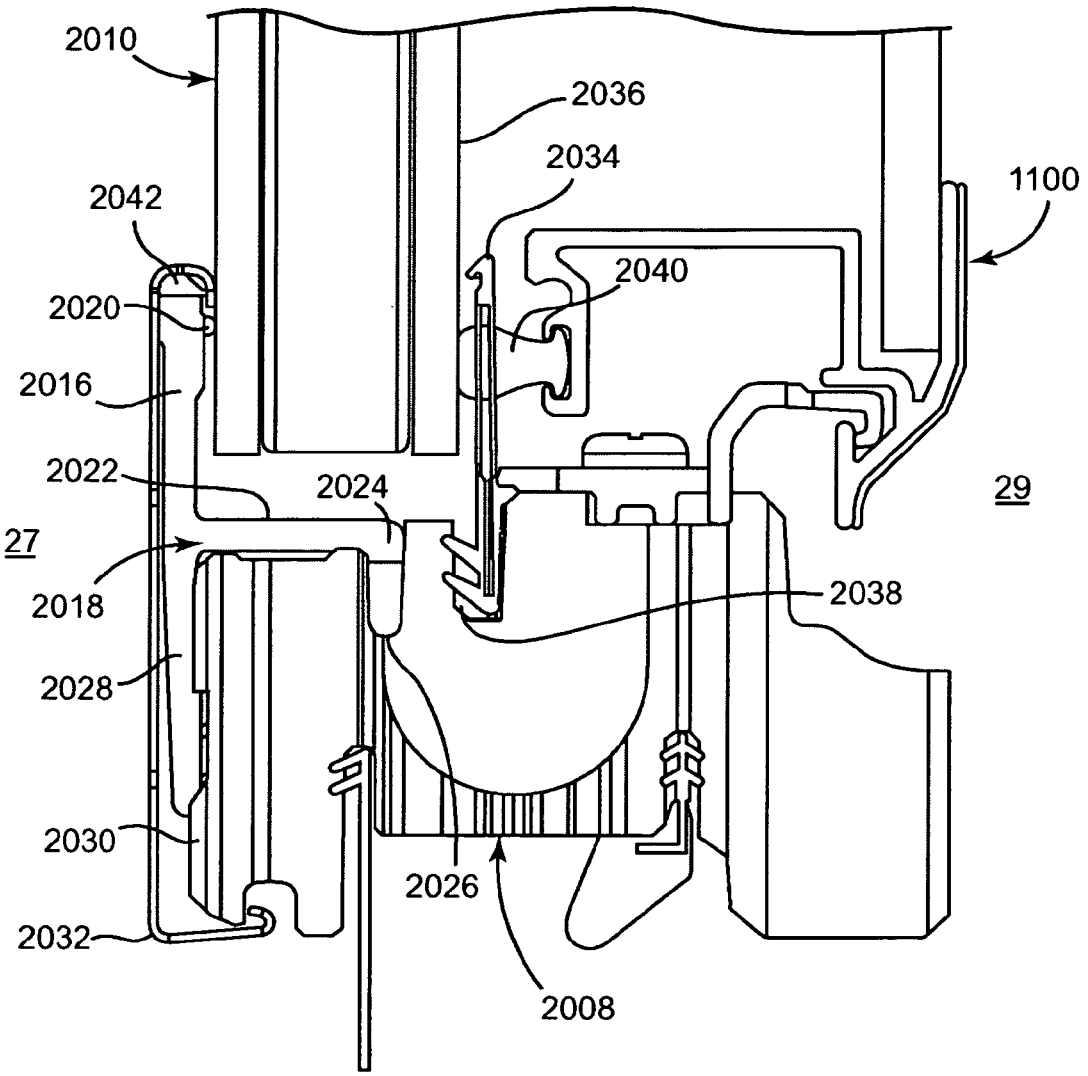
FIG. 19 is an enlarged view of a sash member with a glazing flange in accordance with the present invention.

As discussed above, the secondary sash 1100 can be used with any style window or door, including double hung windows, awning windows, fixed windows, hinged doors, sliding doors, and the like. FIGS. 18 and 19 illustrate a window assembly 2000 having an upper primary sash 2002 and a lower primary sash 2004 arranged in a double hung configuration within a window frame 2006. The primary sashes 2002, 2004 include a plurality of sash members 2008 forming a perimeter frame for the primary glazing panels 2010. In the illustrated embodiment, the primary glazing panels 2010 comprise an insulated glass assembly with a pair of glazing panels. Also in the illustrated embodiment, glazing flange 2018 is located around the perimeter of the primary glazing panels 2010.

Secondary sashes 1100 are attached to each of the primary sashes 2002, 2004 at the interior side 29. The secondary sashes 1100 are substantially the same as discussed above, including being hinged to open toward the interior side 29.

In the embodiment of FIG. 18, the upper primary sash 2002 is adapted to slide downward along a direction 2012. The lower primary sash 2004 is adapted to slide upward along a direction 2014. In either situation, the secondary sashes 1100 move along with the primary sashes 2004, 2006 without obstructing one another.

FIG. 19 is an enlarged cross-sectional view of one of the sash member 2008 of FIG. 18. In the present embodiment, the primary glazing panel 2010 is attached to upper member 2016 of the glazing flange 2018 using adhesive 2020. The glazing flange 2018 is preferably an extruded polymeric member designed to interlock with the sash members 2008. In the illustrated embodiment, the glazing flange 2018 includes a cross member 2022 with an extension 2024 that extends into recess 2026 of the sash member 2008. Lower member 2028 of the glazing flange 2018 abuts exterior surface 2030 of the sash member 2008.

The present glazing flange 2018 is preferably assembled into a perimeter frame with welded corners. The corners of the polymeric glazing flange 2018 can be joined using thermal or ultrasonic welding, solvent bonding, adhesives and a variety of other techniques. The individual sash members 2008 are then assembled around the perimeter frame formed by the glazing flange 2018 to create the primary sashes 2002, 2004.

The present glazing flange 2018 provide a number of benefits over conventional wood glazing surfaces. Once the glazing flange 2018 is welded to form a perimeter frame, it serves as a structural member that increases the strength of the sashes 2002, 2004. Less wood is required for the sash members 2008. The interface between the glazing panel 2010 and the glazing flange 2018 is formed by materials that resist decay. The glazing flange 2018 also provide an excellent surface 2042 for engagement with cladding 2032.

Cladding 2032 is optionally attached to the glazing flange 2018 as illustrated in FIGS. 18 and 19. Perimeter seal 2034 is located along the interior surface 2036 of the primary glazing panels 2010. In the illustrated embodiment, the perimeter seal 2034 is releasably engaged with recess 2038 in the sash members 2008. An adhesive can optionally be located between the interior surface 2036 and the perimeter seal 2034. Seal 2040 on secondary sash 1100 is preferably positioned to engage with a major surface of the perimeter seal 2034.

Figure 20:
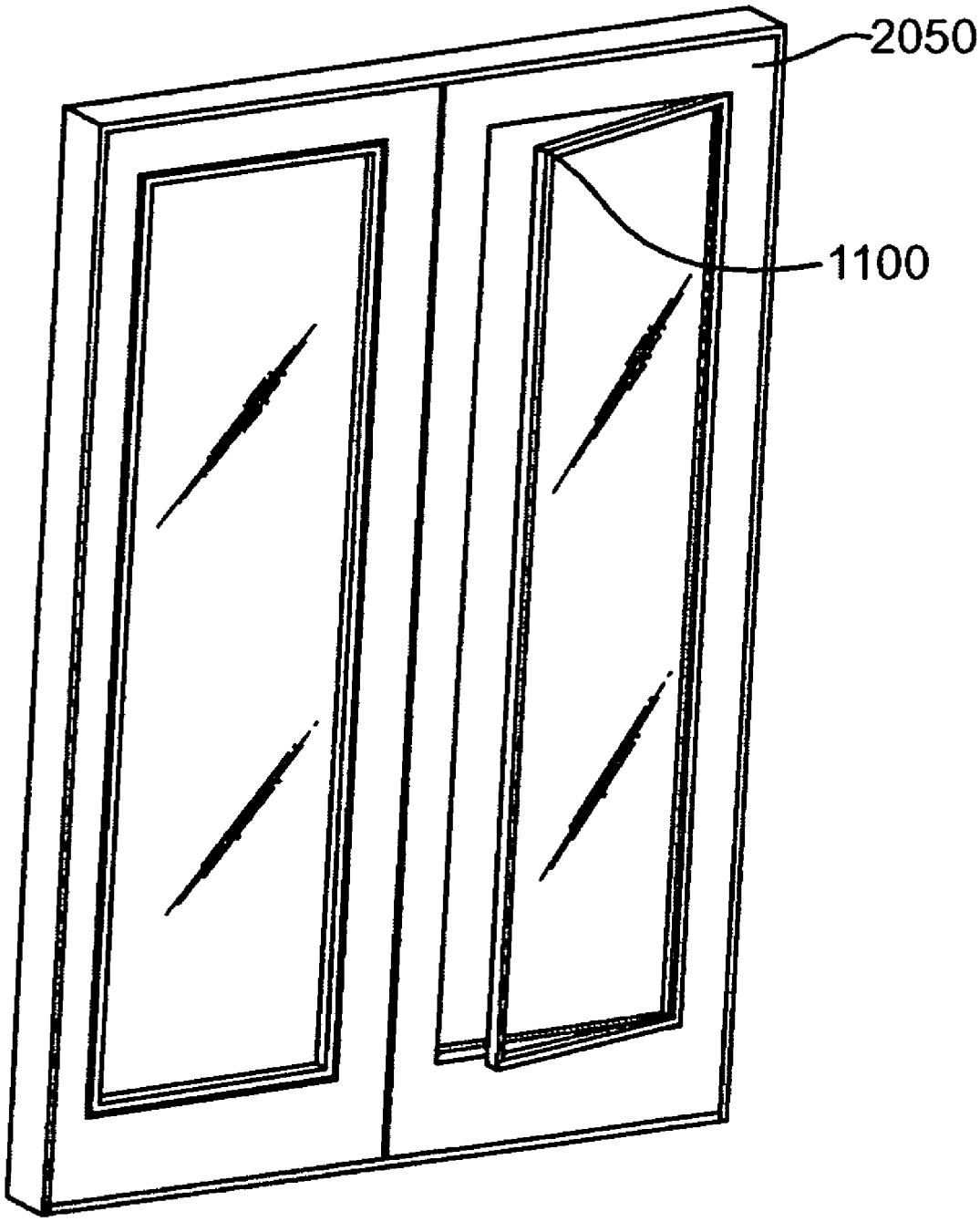
FIG. 20 is a perspective view of an in-swing door having a primary sash and a secondary sash in accordance with the present invention.
Figure 21:
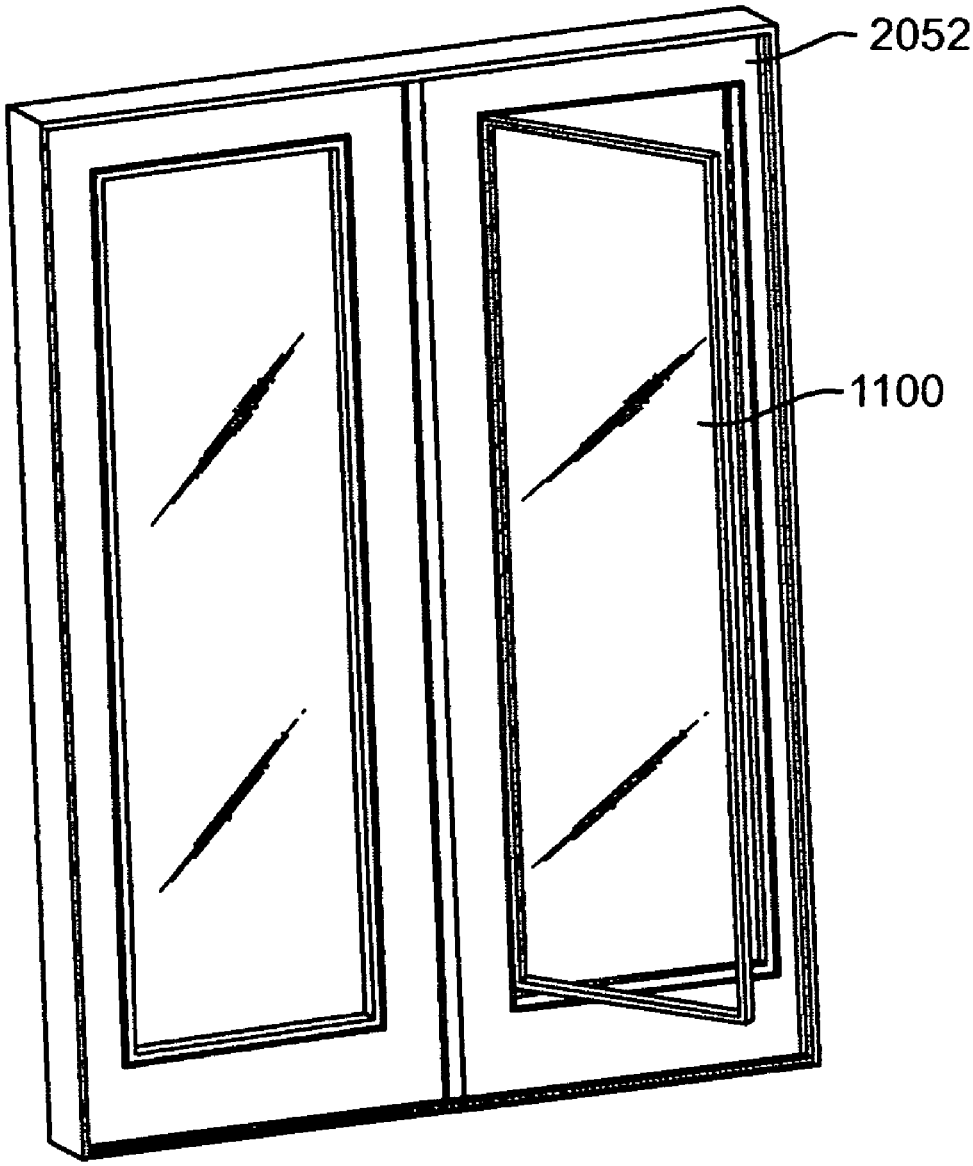
FIG. 21 is a perspective view of an out-swing door having a primary sash and a secondary sash in accordance with the present invention.
Figure 22:
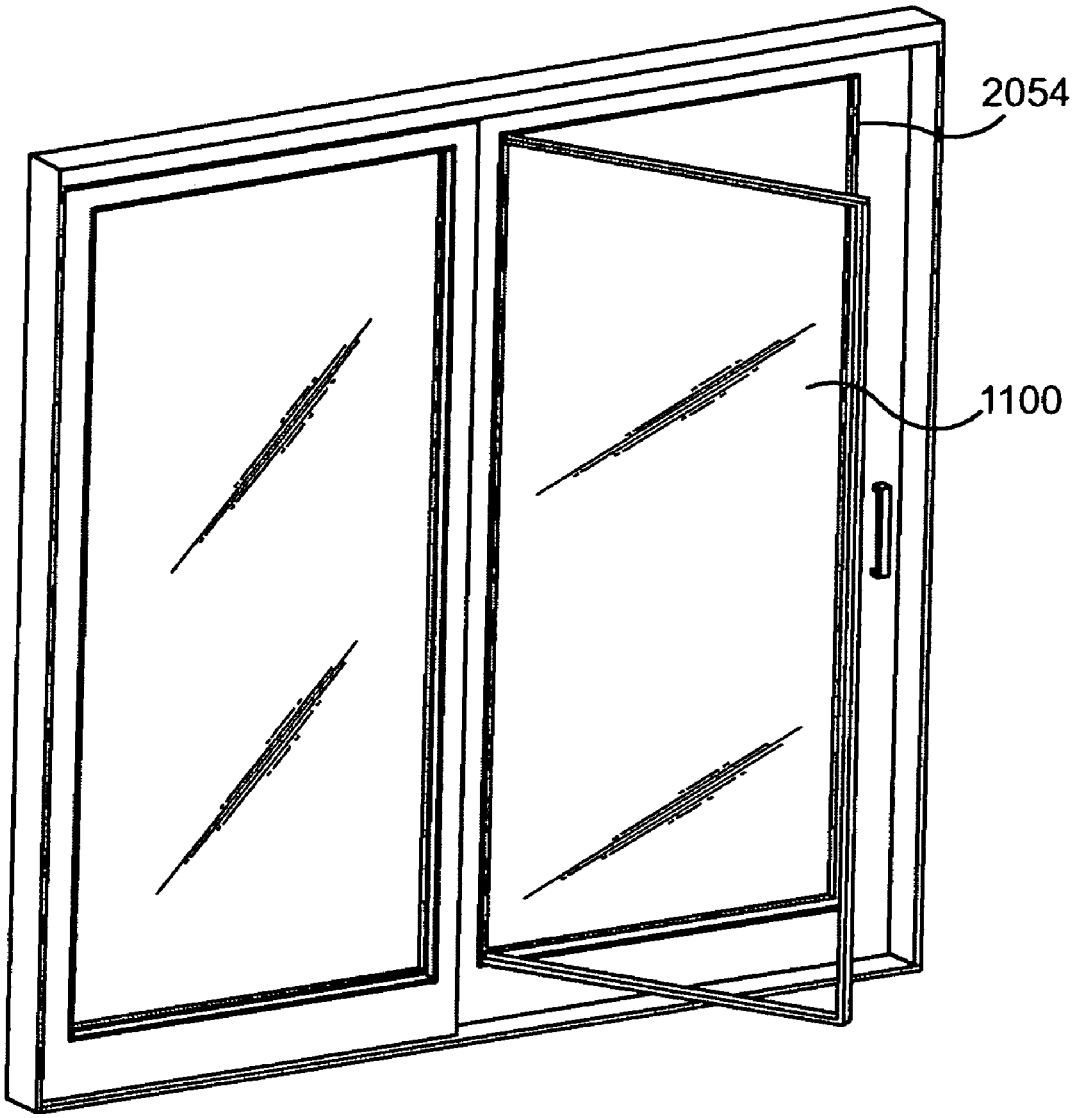
FIG. 22 is a perspective view of a sliding door having a primary sash and a secondary sash in accordance with the present invention.

FIG. 20 is a perspective view of an in-swing door 2050 including the secondary sash 1100 in accordance with the present invention. FIG. 21 is a perspective view of an outswing door 2052 including the secondary sash 1100 in accordance with the present invention. FIG. 22 is a perspective view of a sliding door 2056 including the secondary sash 1100 in accordance with the present invention. Any of the embodiments and features disclosed herein can be incorporated into the doors 2050, 2052, 2054 of FIGS. 20-22.

All patents, patent applications, documents and publications referenced in this document are incorporated by reference herein as if set out in their entirety.

With regard to the foregoing description, it is to be understood that changes may be made in the details, without departing from the scope of the present invention. It is intended that the specification and depicted aspects be considered exemplary only, with a true scope and spirit of the invention being indicated by the broad meaning of the following claims.

What is claimed is:

1. A window assembly comprising:

a window frame;

a primary sash mounted in the window frame, the primary sash having a plurality of sash members forming a primary sash perimeter and a first glazing panel mounted in the primary sash perimeter;

a secondary sash having a plurality of secondary sash members forming a secondary sash structure and a second glazing panel mounted in the secondary sash structure, the secondary sash pivotally attached to the primary sash perimeter along an interior surface thereof so that the secondary sash is rotatably movable between a closed position and an open position relative to the primary sash;

an air chamber located between the primary sash and the secondary sash when the secondary sash is in the closed position;

an accessory channel located along at least one side of the secondary sash members;

at least two window accessory mounting structures located in the air chamber and attached to a top sash member forming the secondary sash structure, the mounting structures separated by a fixed distance; and a window accessory comprising a shade mechanism housing with first and second slots separated by the fixed distance, the first slot extending generally parallel to an axis of the shade mechanism housing and the second slot extending generally perpendicular to the axis of the shade mechanism housing.

2. The window assembly of claim 1 comprising:

a first drive coupler extending through a side sash member forming the secondary sash structure, the first drive coupler located to mechanically couple with a second drive coupler on the window accessory when the window accessory is attached to the first and second mounting structures; and a window accessory drive mechanism located in the accessory channel mechanically coupled to the first drive coupler.

3. The window assembly of claim 1 wherein at least one of the first and second slots comprising one or more detents to releasably engage with the mounting structures.

4. The window assembly of claim 1 comprising a window accessory operating mechanism located in the accessory channel.

5. The window assembly of claim 1, wherein the secondary sash is adapted to be disengaged from the primary sash when the secondary sash is in an open position.

6. A window assembly having an interior side and an exterior side, the window assembly comprising:

a window frame;

a primary sash mounted in the window frame, the primary sash having a plurality of sash members forming a primary sash perimeter and a first glazing panel mounted in the primary sash perimeter;

a secondary sash having a plurality of secondary sash members forming a secondary sash structure and a second glazing panel mounted in the secondary sash structure, the secondary sash pivotally attached directly to the primary sash perimeter along an interior surface thereof by one or more hinge members forming a hinge between the primary sash structure and the secondary sash structure so that the secondary sash is rotatably movable between a closed position and an open position relative to the primary sash, the secondary sash being hinged to open toward the interior side of the window assembly, the hinge adapted to be disengaged upon pivoting and shifting the secondary sash relative to the primary sash from a first position to a second position;

an air chamber located between the primary sash and the secondary sash when the secondary sash is in the closed position;

an accessory channel located in at least one side of the secondary sash members;

a window accessory operating mechanism coupled to at least one of the secondary sash members;

at least two window accessory mounting structures located in the air chamber and attached to a top sash member forming the secondary sash structure, the mounting structures separated by a fixed distance; and a window accessory comprising a shade mechanism housing with first and second slots separated by the fixed distance, the first slot extending generally parallel to an axis of the shade mechanism housing and the second slot extending generally perpendicular to the axis of the shade mechanism housing.

7. The window assembly of claim 6 wherein the secondary sash and the primary sash move as a unitary structure relative to the window frame.

8. The window assembly of claim 6 wherein the primary sash comprises one of a fixed window, double hung window, a casement window, an awning window, a sliding door or a swinging door.

9. The window assembly of claim 6 comprising a window accessory mounting post attached to one of the plurality of sash members forming the secondary sash structure and located in the air chamber.

10. The window assembly of claim 6 comprising a drive opening that extends through one of the sash members forming the secondary sash structure between the accessory channel and the air chamber.

11. The window assembly of claim 6 comprising a window accessory located in the air chamber and releasably attached to one of the sash members forming the secondary sash structure.

12. The window assembly of claim 6 comprising:

a first drive coupler including a tubular structure and extending through one of the sash members forming the secondary sash structure, the first drive coupler releasably coupled with a second drive coupler on a window accessory located in the air chamber, the second drive coupler including a shaft structure received by the tubular structure; and a window accessory drive mechanism located in the accessory channel mechanically coupled to the first drive coupler.

13. The window accessory of claim 12 wherein the first drive coupler slidingly engages with the second drive coupler.

14. The window assembly of claim 6 comprising:

a first drive coupler extending through a side sash member forming the secondary sash structure, the first drive coupler located to mechanically couple with a second drive coupler on the window accessory when the window accessory is attached to the first and second mounting structures; and a window accessory drive mechanism located in the accessory channel mechanically coupled to the first drive coupler.

15. The window assembly of claim 6 wherein at least one of the first and second slots comprising one or more detents to releasably engage with the mounting structures.

16. The window assembly of claim 6 comprising a window accessory located in the air chamber, the window accessory being one or more of a grid, a grille, a shade, a blind, or a window fashion.

17. The window assembly of claim 6 further comprising an air passage extending between the air chamber and an exterior air source when the secondary sash is in the closed position.

18. The window assembly of claim 6 comprising a glazing flange located between the first glazing panel and the plurality of sash members forming the primary sash.

19. The window assembly of claim 18 wherein the glazing flange comprises a unitary structure corresponding to the primary sash perimeter.

20. The window assembly of claim 18 wherein the glazing flange comprises a welded polymeric structure corresponding to the primary sash perimeter.

21. The window assembly of claim 18 comprising exterior cladding attached along at least one edge of the glazing flange.

22. The window assembly of claim 18 wherein the glazing flange comprises an interlocking relationship with the plurality of sash members.

23. The window assembly of claim 18 comprising an adhesive attaching the first glazing panel to the glazing flange.

24. The window assembly of claim 6 comprising a breather system venting the air chamber to an exterior region when the secondary sash is in the closed position.

25. The window assembly of claim 6, wherein the primary sash is hinged to the window frame so that the primary sash swings outwardly toward the exterior side of the window assembly.

26. The window assembly of claim 6, wherein the hinge includes a U-shaped channel and a peripheral edge structure received in the U-shaped channel.

27. The window assembly of claim 6, wherein the secondary sash is adapted to be disengaged from the primary sash when the secondary sash is in an open position.

* * * * *